US010941494B2

(12) United States Patent
Shibata et al.

(10) Patent No.: US 10,941,494 B2
(45) Date of Patent: Mar. 9, 2021

(54) ELECTROLESS PLATINUM PLATING SOLUTION AND PLATINUM FILM OBTAINED USING SAME

(71) Applicant: JAPAN PURE CHEMICAL CO., LTD., Tokyo (JP)

(72) Inventors: Kazuya Shibata, Tokyo (JP); Ukyo Kamimura, Tokyo (JP)

(73) Assignee: JAPAN PURE CHEMICAL CO., LTD., Tokyo (JP)

( * ) Notice: Subject to any disclaimer, the term of this patent is extended or adjusted under 35 U.S.C. 154(b) by 0 days.

(21) Appl. No.: 16/612,942

(22) PCT Filed: Dec. 11, 2017

(86) PCT No.: PCT/JP2017/044265
§ 371 (c)(1),
(2) Date: Nov. 12, 2019

(87) PCT Pub. No.: WO2018/211727
PCT Pub. Date: Nov. 22, 2018

(65) Prior Publication Data

US 2020/0157686 A1 May 21, 2020

(30) Foreign Application Priority Data

May 18, 2017 (JP) ..... JP2017-098885

(51) Int. Cl.
*C23C 18/44* (2006.01)
*C23C 18/16* (2006.01)

(52) U.S. Cl.
CPC ..... *C23C 18/44* (2013.01); *C23C 18/168* (2013.01); *C23C 18/1639* (2013.01)

(58) Field of Classification Search
None
See application file for complete search history.

(56) References Cited

U.S. PATENT DOCUMENTS 6,773,573 B2 * 8/2004 Gabe ..... C25D 3/02 205/296
8,317,910 B2 * 11/2012 Cheung ..... B32B 15/018 106/1.28

(Continued)

FOREIGN PATENT DOCUMENTS

EP 3 363 928 A1 8/2018
JP 9-287078 A 11/1997

(Continued)

OTHER PUBLICATIONS

Machine translation of WO 2017/069121, first published in Japanese Apr. 2017, 12 pages. (Year: 2017).*

(Continued)

*Primary Examiner* — Helene Klemanski
(74) *Attorney, Agent, or Firm* — Westerman, Hattori, Daniels & Adrian, LLP

(57) ABSTRACT

An electroless platinum plating solution is disclosed that can be subjected to plating processing with high deposition efficiency, does not self-decompose even when it does not contain sulfur or heavy metals, and has excellent bath stability, and an electroless platinum plating solution that can suppresses out-of-pattern deposition of platinum and perform platinum plating only on a necessary portion. An electroless platinum plating solution is disclosed that contains a soluble platinum salt, a complexing agent and any of a borohydride compound, an aminoborane compound and a hydrazine compound, and has a pH of 7 or more, adding a specific hydroxymethyl compound represented by the following formula (1) or a salt thereof:

$$R^1—CH_2—OH \quad (1)$$

wherein $R^1$ is an atomic group having an aldehyde group or a ketone group.

20 Claims, 5 Drawing Sheets

(56) References Cited

U.S. PATENT DOCUMENTS

| | | | | |
|---|---|---|---|---|
| 2010/0055422 | A1* | 3/2010 | Kong | H01L 21/0332 428/209 |
| 2017/0044671 | A1* | 2/2017 | Milum | C23C 18/1844 |
| 2018/0305819 | A1* | 10/2018 | Kato | C23C 18/44 |
| 2020/0095686 | A1* | 3/2020 | Polczynski | C23C 18/44 |

FOREIGN PATENT DOCUMENTS

| | | | |
|---|---|---|---|
| JP | 2002-173780 | A | 6/2002 |
| JP | 3416901 | B2 | 6/2003 |
| JP | 2012/117111 | A * | 6/2012 |
| JP | 2016-37612 | A1 | 3/2016 |
| WO | 2013/094544 | A1 | 6/2013 |
| WO | 2014/162935 | A1 | 10/2014 |
| WO | 2017/064874 | A1 | 4/2017 |
| WO | 2017/069121 | A1 | 4/2017 |

OTHER PUBLICATIONS

English translation of of the Written Opinion of the International Search Authority dated Jan. 9, 2019 for PCT/JP2017/044265; 4 pages.*
English translation of WO 2017/069121, Apr. 2017; 26 pages.*
English translation of WO 2014/162935, Oct. 2014; 18 pages.*
English translation of WO 2013/094544, Jun. 2013; 16 pages.*
English translation of JP 2002/173780, Jun. 2002; 11 pages.*
English translation of JP 2016/037612, Mar. 2016; 19 pages.*
English translation of JPH 09/287078, Nov. 1997; 8 pages.*
English translation of JP 2012/117111, Jun. 2012; 11 pages.*
International Search Report dated Jan. 9, 2018, issued in counterpart International Application No. PCT/JP2017/044265, with English Translation. (4 pages).

* cited by examiner

[FIG. 1]
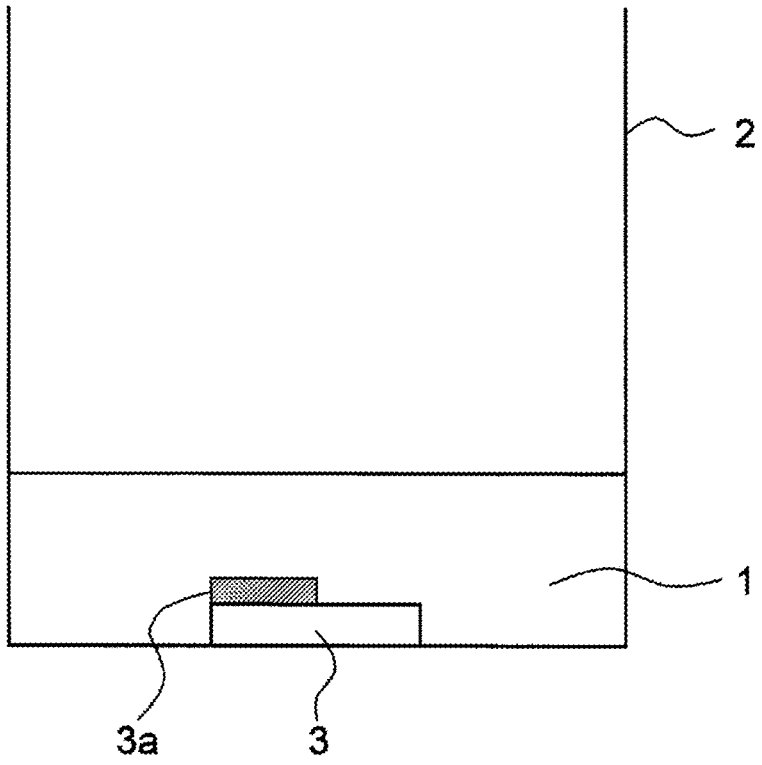

[FIG. 2]
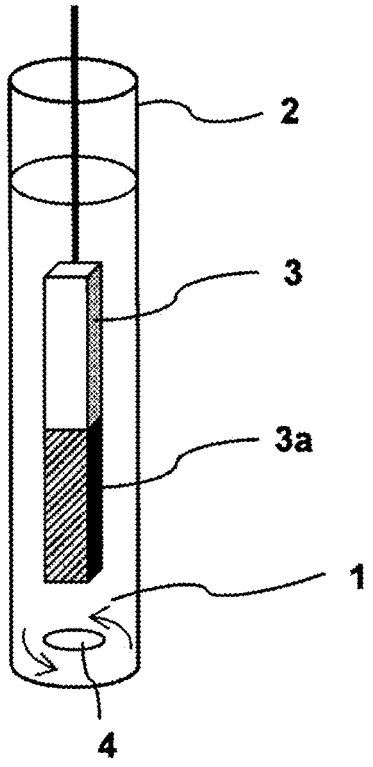

[FIG. 3]
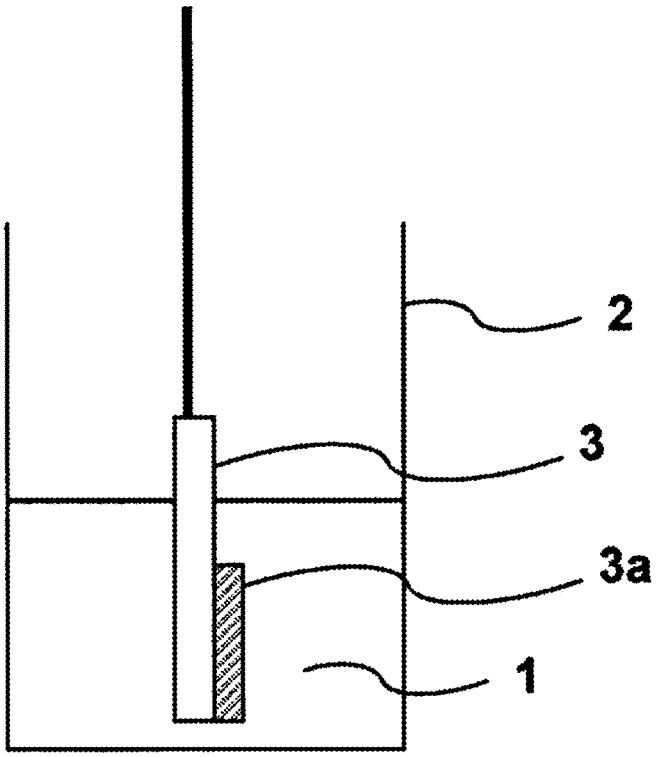

[FIG. 4]
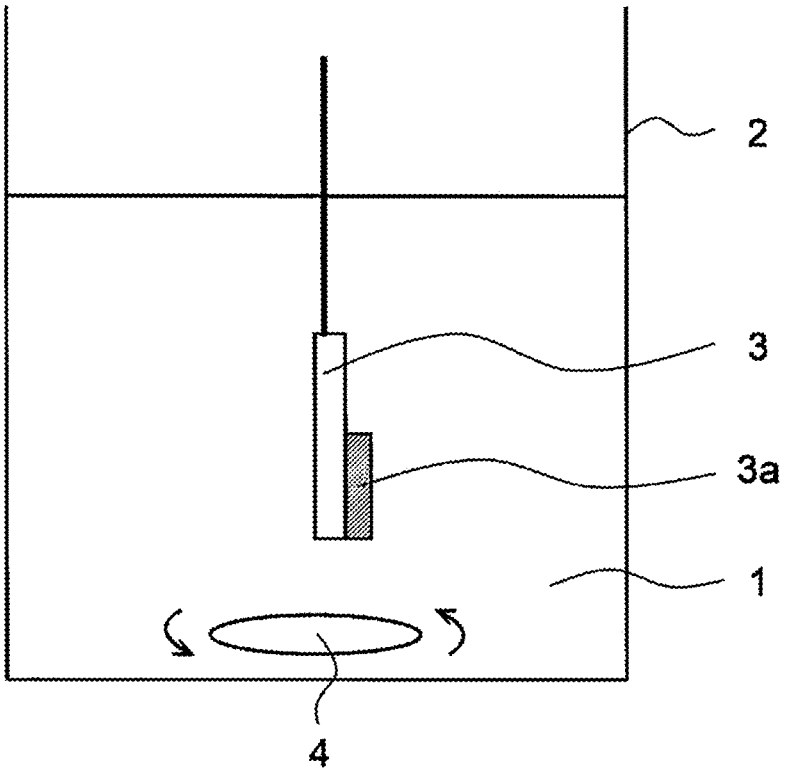

[FIG. 5]
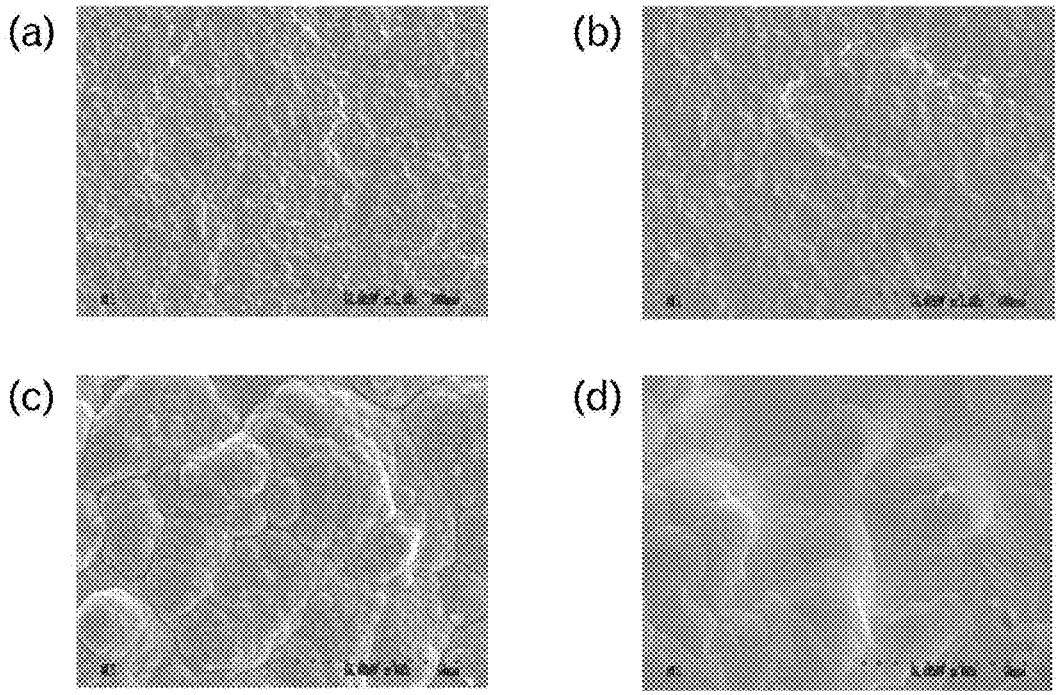
[FIG. 6]
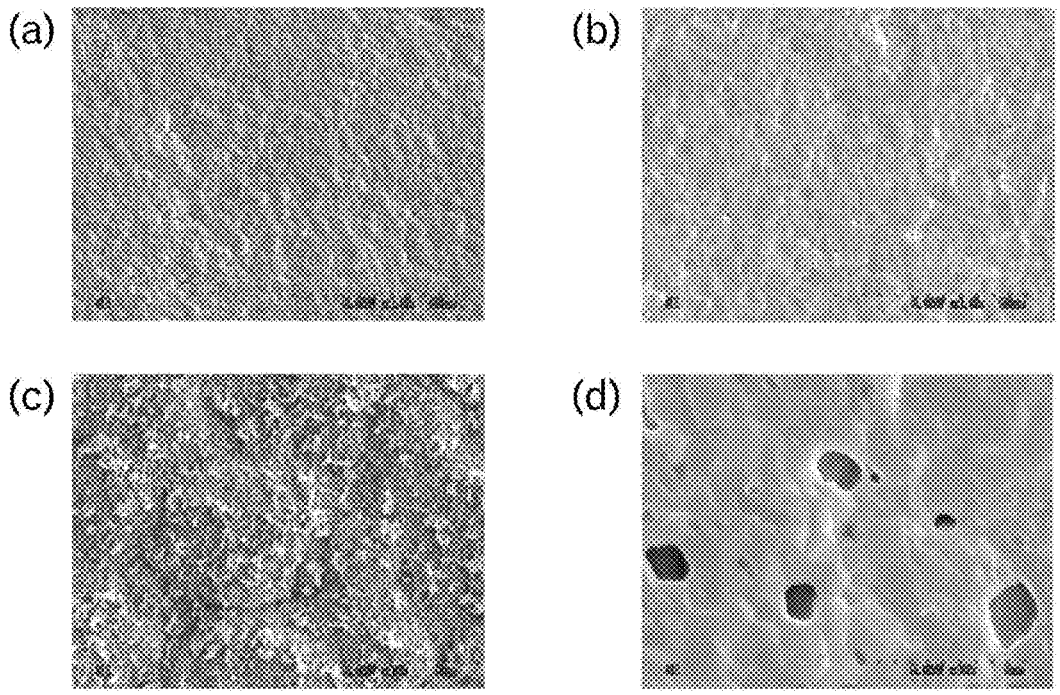

ELECTROLESS PLATINUM PLATING SOLUTION AND PLATINUM FILM OBTAINED USING SAME

TECHNICAL FIELD

The present invention relates to an electroless platinum plating solution having a specific composition, a solution for initially making up the electroless platinum plating solution, a method for producing a platinum plating film using the electroless platinum plating solution, an electroless platinum plating film obtained by using the method (in particular, an electroless platinum plating film formed on a ceramic substrate).

Hereinafter, in this description, the "electroless platinum plating solution" may be simply abbreviated as a "plating solution", the "(electroless) platinum plating film" simply as a "plating film" or "platinum film", and the "(electroless) platinum plating" simply as a "plating".

BACKGROUND ART

Platinum is extremely chemically stable and hardly oxidized, and its melting point is higher than those of other noble metals. Accordingly, due to its durability, platinum is widely used for parts exposed to harsh environments. Also, a ceramic has heat resistance. Accordingly, a platinum film formed on a ceramic can be widely used as an electrode having excellent heat resistance.

Formation of a platinum film on a ceramic that is a nonconductor is often performed by providing a catalyst layer, followed by an electroless plating method. A method for producing a platinum film using an electroless platinum plating solution includes batch processing or continuous processing, which are appropriately selected as an optimal method depending on the cost and productivity.

In the case of batch processing, a large number of small plating baths (containers) are prepared in parallel, and parts are put into the individual baths to be plated at once. A plating solution is for single use. Accordingly, in order to reduce the platinum-recovery cost from the plating waste, an electroless platinum plating solution is required that allows platinum contained in the plating solution to be plated and deposited on a substrate without waste, in other words, that can be plated with high deposition efficiency.

On the other hand, in the case of continuous processing, a large plating tank is prepared, in which plating processing is continuously performed by repeating introduction of a substrate on which a plurality of parts are imposed. Accordingly, an electroless platinum plating solution is required that is capable of providing a desired film thickness for a short time, and is high in speed and excellent in stability.

In addition, depending on the part, a platinum plating film is often formed only on a necessary portion. In other words, instead of forming a platinum plating film on the entire surface of a substrate, it is necessary to form a pattern on a substrate using a catalyst layer and selectively form a platinum plating film only on the pattern.

In this case, it is not preferable that the platinum plating film be out of the pattern, because the cost is increased and the performance of the part is deteriorated. Accordingly, an electroless platinum plating solution is required that hardly exhibits out-of-pattern deposition.

Furthermore, depending on the use of platinum plating film, a pure platinum plating film, which has a small eutectic amount of impurity such as sulfur (S) or a heavy metal, is desired because the impurity affects the characteristics of the platinum plating film.

Patent Literature 1 discloses an electroless platinum plating solution containing a thiol compound as an additive. The invention described in Patent Literature 1 has a problem that the plating speed is low although the thiol compound effectively suppresses the self-decomposition of the plating solution. In addition, the sulfur compound having a low valence such as the thiol compound is not preferable because sulfur co-deposits in the platinum plating film.

Patent Literature 2 discloses an electroless platinum plating solution using borohydride salt as a reducing agent, especially a plating solution that prevents decomposition of the plating solution and suppresses out-of-pattern deposition of the platinum plating film by allowing a very small amount of thallium (Ti) ions or tellurium (Te) ions to coexist, and a specific oxidizing agent (a nitro compound such as sodium nitrobenzene sulfonate) to be contained.

However, this plating solution has a problem that thallium ions or tellurium ions, which are stabilizers, co-deposit in a platinum plating film, so that a pure platinum film cannot be obtained. In addition, although it is intended to suppress out-of-pattern deposition by allowing a specific oxidizing agent (nitro compound) to be contained, it has been found according to the additional tests by the present inventors that the effect is insufficient (Examples described later).

Patent Literature 3 discloses an electroless platinum plating solution using a borohydride compound as a reducing agent, especially an electroless platinum plating solution having a hydrazine compound added as a stabilizer in order to suppress self-decomposition of the boron hydride compound that is a reducing agent and to prevent abnormal deposition of platinum.

However, it has been found according to the additional tests by the present inventors that although this plating solution contains no heavy metal ions so that a pure platinum plating film can be obtained, a remarkable improvement in bath stability due to addition of hydrazine cannot be provided (Examples described later). In addition, it is disclosed that a specific oxidizing agent (nitro compound) is added as a long-term stabilizer for prevention of out-of-pattern deposition. This is within the same idea as that of Patent Literature 2, and it has been found that a remarkable effect cannot be achieved.

Patent Literature 4 discloses an electroless platinum plating solution containing ammonia and using a hydrazine compound as a reducing agent, especially an electroless platinum plating solution that is excellent in high temperature stability and that can prevent out-of-pattern deposition by the devisal of a platinum complex to be used. However, it has been found according to the additional tests by the present inventors that a sufficient effect to suppress out-of-pattern deposition cannot be achieved (Examples described later).

As described above, prior arts cannot be said to have sufficient performance to achieve both high deposition efficiency and suppression of out-of-pattern deposition, and further to produce a pure platinum plating film without impurities such as sulfur and heavy metals. Accordingly, further improvements have been required.

CITATION LIST

Patent Literature

Patent Literature 1: JP 3416901 B2
Patent Literature 2: WO 2014/162935 A
Patent Literature 3: JP 2016-037612 A
Patent Literature 4: WO 2013/094544 A

SUMMARY OF INVENTION

Technical Problem

The present invention has been made in view of the above-mentioned background art. An object of the present invention is to provide an electroless platinum plating solution that can be subjected to plating processing at high speed and with high deposition efficiency, that does not self-decompose even when it does not contain sulfur or heavy metals, and that is excellent in stability. Another object of the present invention is to provide an electroless platinum plating solution capable of suppressing out-of-pattern deposition of platinum and performing platinum plating only on a necessary portion, and a method for producing a platinum plating film using such an electroless platinum plating solution. Another object of the present invention is to provide a pure platinum plating film that does not substantially contain sulfur or heavy metals.

Solution to Problem

As a result of intensive studies to solve the above problems, the present inventors have found that the above-mentioned problems are solved by forming a platinum plating film using an electroless platinum plating solution having a pH of 7 or more in which a specific compound having an aldehyde group or a ketone group is used in combination with a specific reducing agent, so that it is possible to achieve both high-speed and high deposition efficiency plating, and pattern plating. In this way, the present invention has been completed.

The present invention provides an electroless platinum plating solution containing a soluble platinum salt, a complexing agent, and a reducing agent that is any of a borohydride compound, an aminoborane compound, and a hydrazine compound, the electroless platinum plating solution having a pH of 7 or more, and containing a specific hydroxymethyl compound represented by the following formula (1) or a salt thereof:

$$R^1—CH_2—OH \quad (1)$$

wherein $R^1$ is an atomic group having an aldehyde group or a ketone group.

In addition, the present invention provides a solution A for initially making up the above-mentioned electroless platinum plating solution, the solution A containing a soluble platinum salt and a specific hydroxymethyl compound represented by the following formula (1) or a salt thereof:

$$R^1—CH_2—OH \quad (1)$$

wherein $R^1$ is an atomic group having an aldehyde group or a ketone group.

In addition, the present invention provides a solution B for initially making up the above-mentioned electroless platinum plating solution, the solution B containing a complexing agent and a reducing agent that is any of a borohydride compound, an aminoborane compound, and a hydrazine compound.

In addition, the present invention provides a method for producing a platinum plating film including immersing an object to be plated in an electroless platinum plating solution at 20 to 90° C. to form the platinum plating film, the electroless platinum plating solution being initially made up by premixing the above-mentioned solution A and the above-mentioned solution B.

In addition, the present invention provides a platinum plating film that is formed on an object to be plated using the above-mentioned method for producing a platinum plating film.

The present invention also provides an aqueous solution for preparing the above-mentioned electroless platinum plating solution by adding a soluble platinum salt and a reducing agent that is any of a borohydride compound, an aminoborane compound, and a hydrazine compound, the aqueous solution containing a complexing agent and a specific hydroxymethyl compound represented by the following formula (1) or a salt thereof:

$$R^1—CH_2—OH \quad (1)$$

wherein $R^1$ is an atomic group having an aldehyde group or a ketone group.

Advantageous Effects of Invention

According to the electroless platinum plating solution of the present invention, it is possible both to suppress platinum deposition on a portion other than a pattern to provide platinum plating only on a necessary portion, and to achieve high-speed and high deposition efficiency plating, so that the production cost can be greatly reduced.

In addition, according to the method for producing an electroless platinum plating film of the present invention, a platinum pattern film can be stably formed with a high yield in electroless platinum plating processing, which has been conventionally difficult.

Furthermore, according to the method for producing an electroless platinum plating film of the present invention, when performing pattern plating of platinum plating, it is possible to perform plating with a substrate left standing without using an expensive oscillating device, so that remarkable cost reduction can be achieved.

The platinum plating film of the present invention is industrially useful because when formed on the surface of a ceramic such as alumina, silicon nitride and aluminum nitride, there are few defective parts such as cracks and pinholes, and the yield on products using the platinum plating film can be improved.

BRIEF DESCRIPTION OF DRAWINGS

FIG. 1 shows a schematic diagram in a glass beaker when a platinum film for evaluation is formed without stirring in Experimental Example 1 and Experimental Example 4.

FIG. 2 shows a schematic diagram in a glass beaker when a platinum film for evaluation is formed with stirring in Experimental Example 2.

FIG. 3 shows a schematic diagram in a glass beaker when a platinum film for evaluation is formed without stirring in Experimental Example 3.

FIG. 4 shows a schematic diagram in a glass beaker when a platinum film for evaluation is formed with stirring in Experimental Example 5.

FIG. 5 is a scanning electron microscope (SEM) photograph of a platinum plating film formed on a pattern in Example a4 of Experimental Example 1. (a) Immediately after plating (1000 times magnification), (b) after annealing (1000 times magnification), (c) immediately after plating (10000 times magnification), and (d) after annealing (10000 times magnification).

FIG. 6 is a scanning electron microscope (SEM) photograph of a platinum plating film formed on a pattern in Example b2 of Experimental Example 1. (a) Immediately after plating (1000 times magnification), (b) after annealing (1000 times magnification), (c) immediately after plating (10000 times magnification), and (d) after annealing (10000 times magnification).

DESCRIPTION OF EMBODIMENTS

Hereinafter, a description will be made of the present invention. The present invention is not limited to the following embodiments, but may be appropriately modified for implementation.

[Electroless Platinum Plating Solution]

An electroless platinum plating solution of the present invention contains a soluble platinum salt, a complexing agent, a specific reducing agent and a specific hydroxymethyl compound represented by the following formula (1) or a salt thereof, and has a pH of 7 or more.

Furthermore, the electroless platinum plating solution of the present invention may contain an aliphatic unsaturated compound, an N-containing heterocyclic compound and other components.

<Soluble Platinum Salt>

The electroless platinum plating solution of the present invention is essential to contain a soluble platinum salt. The soluble platinum salt is used as a platinum source for the electroless platinum plating solution of the present invention. The soluble platinum salt is not limited to one type, and two or more types can be used in combination. The word "soluble" means to be soluble in water.

Specific examples of the soluble platinum salt include tetraammineplatinum (II) salt, hexaammineplatinum (IV) salt, tetrachloroplatinate (II), hexachloroplatinate (IV), tetranitroplatinate (II), hexanitroplatinate (IV), dinitrodiammineplatinum (II), dinitrodichloroplatinate (II) and diamminedichloroplatinum (II) (cis form is known as "cisplatin").

These soluble platinum salts easily exert the above-mentioned effects of the present invention, and are also preferable from the viewpoint of good electroless platinum plating performance, ease of dissolution in water, availability, low cost, and the like.

Among them, from the above viewpoint, particularly preferable examples thereof include divalent platinum salts such as tetraammineplatinum (II) salt, tetrachloroplatinate (II), tetranitroplatinate (II), dinitrodiammineplatinum (II) and dinitrodichloroplatinate (II).

Examples of the counter anion with respect to the complex ion in tetraammineplatinum (II) salt, hexaammineplatinum (IV) salt, and the like include a halogen ion (a chlorine ion, a bromine ion, an iodine ion), a hydroxide ion, a nitrate ion, a sulfate ion, a sulfamate ion, a phosphate ion, a hydrogen carbonate ion, an acetate ion, an oxalate ion, and a citrate ion.

Examples of the counter cation with respect to the complex ion in tetrachloroplatinate (II), hexachloroplatinate (IV), tetranitroplatinate (II), hexanitroplatinate (IV), dinitrodichloroplatinate (II), and the like include a lithium ion, a sodium ion, a potassium ion, and an ammonium ion.

Particularly preferable specific examples of the soluble platinum salts include tetraammineplatinum (II) hydrochloride, tetraammineplatinum (II) hydroxide, tetraammineplatinum (II) hydrogen carbonate, tetraammineplatinum (II) acetate, tetraammineplatinum (II) nitrate, tetraammineplatinum (II) citrate, tetrachloroplatinate (II), tetranitroplatinate (II), dinitrodiammineplatinum (II) and dinitrodichloroplatinate (II).

These specific examples of the soluble platinum salts more easily exert the above-mentioned effects of the present invention, and are also particularly preferable from the viewpoint of good electroless platinum plating performance, ease of dissolution in water, availability, low cost, and the like.

The content of the soluble platinum salt in the electroless platinum plating solution of the present invention is not particularly limited, but is preferably 0.001 g/L to 100 g/L, more preferably 0.01 g/L to 50 g/L, particularly preferably 0.05 g/L to 30 g/L as metal platinum with respect to the entire electroless platinum plating solution.

When the content of the soluble platinum salt in the electroless platinum plating solution is too low, it may be difficult to form a platinum film having a normal and uniform tone of color. In other words, when the color and deposition property of the platinum film are visually observed, an abnormal deposition of platinum may be observed.

On the other hand, when the content of the soluble platinum salt in the electroless platinum plating solution is too high, although there is no particular problem with the performance of electroless platinum plating solution, soluble platinum salts are so expensive that it may be uneconomical for storage in a state of being contained in an electroless platinum plating solution.

The above-mentioned description about the soluble platinum salt specifies the form present in the electroless platinum plating solution of the present invention, but as a raw material to be dissolved in preparation of the electroless platinum plating solution of the present invention, it is preferable to use the above-mentioned soluble platinum salt.

<Complexing Agent>

The electroless platinum plating solution of the present invention is essential to contain a complexing agent. The complexing agent is used as a ligand source for the electroless platinum plating solution of the present invention, and contributes to the stability of the plating solution. One type of the complexing agents may be used alone, or two or more types thereof may be used in combination.

Specific examples of the complexing agent include polyamine compounds (compounds having a plurality of amino groups (—NH2)) such as ethylenediamine, propanediamine, diethylenetriamine, triethylenetetramine, tris(2-aminoethyl)amine, tetraethylenepentamine, pentaethylenehexamine, N,N-bis(3-aminopropyl)ethylenediamine; and ammonia.

These polyamine compounds easily exert the above-mentioned effects of the present invention, and are also preferable from the viewpoint of good electroless platinum plating performance, ease of dissolution in water, availability, low cost, and the like.

Among them, from the viewpoint of the stability of the plating solution, particularly preferable examples include linear polyamine compounds such as ethylenediamine, propanediamine, diethylenetriamine, triethylenetetramine, tetraethylenepentamine, pentaethylenehexamine and N,N'-bis(3-aminopropyl)ethylenediamine.

The content of the complexing agent in the electroless platinum plating solution of the present invention is preferably at least equivalent to the platinum ions in the plating solution for coordination. The content is more preferably 0.1 g/L to 1000 g/L, more preferably 1 g/L to 500 g/L, particularly preferably 10 g/L to 300 g/L as a complexing agent with respect to the entire electroless platinum plating solution.

When the content of the complexing agent in the electroless platinum plating solution is too low, the stability of the plating solution may decrease, platinum may be abnormally deposited in the plating solution during plating or heating, or the plating solution may decompose.

On the other hand, when the content of the complexing agent in the electroless platinum plating solution is too high, the solubility of coexisting components may decrease due to decrease in the amount of water in the plating solution, and the uniformity of the platinum plating film thickness may be adversely affected due to increase in the viscosity of the plating solution.

<Reducing Agent>

The electroless platinum plating solution of the present invention is essential to contain a borohydride compound, an aminoborane compound or a hydrazine compound as a reducing agent. Using such a reducing agent can provide practical high-speed platinum plating through batch processing.

On the other hand, it is not preferable to use any two or more types of the borohydride compound, the aminoborane compound and the hydrazine compound in combination. This is because, when the route of the platinum reduction reaction is simplified without using the reducing agents in combination, and the specific hydroxymethyl compound represented by the formula (1) described later (or a salt thereof) is added, the above-mentioned effects of the present invention are easily obtained.

<<Borohydride Compound>>

Examples of the borohydride compound (borohydride salt) contained in the electroless platinum plating solution of the present invention include sodium borohydride, potassium borohydride and lithium borohydride. One type of them may be used alone, or 2 or more types thereof may be mixed for use.

Among them, from the viewpoint of availability, low cost and the like, sodium borohydride is preferable.

The content (total content) of the borohydride salt in the electroless platinum plating solution of the present invention is not particularly limited, but is more preferably 0.01 g/L to 20 g/L, more preferably 0.05 g/L to 10 g/L, particularly preferably 0.1 g/L to 5 g/L as a borohydride salt with respect to the entire electroless platinum plating solution.

When the content is more than or equal to the above lower limit, the deposition rate of platinum tends to be sufficient. When the content is less than or equal to the above upper limit, it is advantageous in terms of cost, and impurities are hardly generated in the plating film.

<<Aminoborane Compound>>

Examples of the aminoborane compound contained in the electroless platinum plating solution of the present invention include aminoborane, dimethylaminoborane and diethylaminoborane. One type of them may be used alone, or 2 or more types thereof may be mixed for use.

The content (total content) of the aminoborane compound in the electroless platinum plating solution of the present invention is not particularly limited, but is more preferably 0.005 g/L to 5 g/L, more preferably 0.02 g/L to 2 g/L, particularly preferably 0.05 g/L to 1 g/L with respect to the entire electroless platinum plating solution.

When the content is more than or equal to the above lower limit, the deposition rate of platinum tends to be sufficient. When the content is less than or equal to the above upper limit, it is advantageous in terms of cost, and impurities are hardly generated in the plating film.

<<Hydrazine Compound>>

Examples of the hydrazine compound (hydrazine derivative) contained in the electroless platinum plating solution of the present invention include hydrazine monohydrate, hydrazine sulfate, hydrazine hydrochloride and hydrazine phosphate. One type of them may be used alone, or 2 or more types thereof may be mixed for use.

Among them, hydrazine monohydrate is preferable.

The content (total content) of the hydrazine compound in the electroless platinum plating solution of the present invention is not particularly limited, but is more preferably 0.005 g/L to 5 g/L, more preferably 0.02 g/L to 2 g/L, particularly preferably 0.05 g/L to 1 g/L with respect to the entire electroless platinum plating solution.

When the content is more than or equal to the above lower limit, the deposition rate of platinum tends to be sufficient. When the content is less than or equal to the above upper limit, it is advantageous in terms of cost, and impurities are hardly generated in the plating film.

<Specific Hydroxymethyl Compound Represented by Formula (1)>

The electroless platinum plating solution of the present invention contains a specific hydroxymethyl compound represented by the following formula (1) or a salt thereof.

$$R^1—CH_2—OH \quad (1)$$

In the formula (1), le is an atomic group having an aldehyde group (formyl group) or a ketone group.

$R^1$ may be composed of only carbon atoms, hydrogen atoms and oxygen atoms, or may have, in addition to these atoms, a halogen atom and the like.

In addition, the number of aldehyde group or ketone group possessed by $R^1$ may be one, or two or more. Both an aldehyde group and a ketone group may be possessed.

The specific hydroxymethyl compound represented by the formula (1) (or a salt thereof) has an aldehyde group (formyl group) or a ketone group.

Using the specific hydroxymethyl compound represented by the formula (1) (or a salt thereof) in combination with the above-mentioned reducing agent can provide the above-mentioned effects of the present invention.

Examples of the specific hydroxymethyl compound represented by the formula (1) (or a salt thereof) include sugars, specific cyclic carboxylic acids (or a salt thereof), and hydroxymethylfurfural.

The sugar represented by the formula (1) is not particularly limited as long as it has an aldehyde group (formyl group) or a ketone group, and has reducibility. In case of having a ketone group, there is no particular limitation as long as the sugar isomerizes to a sugar having an aldehyde group (formyl group) by keto-enol tautomerism.

Specific examples of the sugar represented by the formula (1) include monosaccharides such as glyceraldehyde, dihydroxyacetone, erythrose, threose, ribulose, xylulose, ribose, deoxyribose, arabinose, xylose, lyxose, psicose, fructose, sorbose, tagatose, glucose, galactose, mannose, allose and altrose; disaccharides such as dihydroxyacetone dimer, lactose, lactulose, maltose and cellobiose; and trisaccharides such as maltotriose.

On the other hand, sucrose and trehalose are sugars, but do not correspond to the specific hydroxymethyl compound represented by the formula (1) because they do not have reducibility (cannot have a ring-opening structure).

Examples of the cyclic carboxylic acid represented by the formula (1) include ascorbic acid, erythorbic acid, dehydroascorbic acid, dehydroerythorbic acid and diketogulonic acid.

Examples of the salt of the cyclic carboxylic acid represented by the formula (1) include a potassium salt, sodium salt, lithium salt and ammonium salt of the above-mentioned acids.

Among the cyclic carboxylic acids represented by the formula (1), even those having no reducibility such as dehydroascorbic acid, dehydroerythorbic acid and diketogulonic acid can also provide the above-mentioned effects of the present invention. This is presumed to be because, when used in combination with the reducing agent of the present invention, cyclic carboxylic acids having reducibility such as ascorbic acid and erythorbic acid are generated in the plating solution.

Examples of the hydroxymethylfurfural represented by the formula (1) include 5-hydroxymethylfurfural.

<Aliphatic Unsaturated Compound>

The electroless platinum plating solution of the present invention may contain an aliphatic unsaturated compound. The aliphatic unsaturated compound exhibits an action as a stabilizer in the plating solution, and maintains the performance of the plating solution when stored for a long period of time.

Among the aliphatic unsaturated compounds, aliphatic unsaturated alcohols or aliphatic unsaturated carboxylic acids are preferable from the viewpoint of easily exerting the above-mentioned effects.

Specific examples of the aliphatic unsaturated alcohol may include alcohols having a double bond such as butenediol, pentenediol, hexenediol, heptenediol, octenediol and nonenediol; alcohols having a triple bond such as propargyl alcohol, methylbutynol, methylpentynol, butynediol, pentynediol, hexynediol, heptynediol, octynediol and nonynediol.

Specific examples of the aliphatic unsaturated carboxylic acid may include carboxylic acids having a double bond such as acrylic acid, methacrylic acid, crotonic acid, angelic acid, tiglic acid, fumaric acid, maleic acid, glutaconic acid, citraconic acid, mesaconic acid and aconitic acid; carboxylic acids having a triple bond such as 3-butynoic acid and 2-butynedioic acid (acetylenedicarboxylic acid).

Among the aliphatic unsaturated alcohols, aliphatic unsaturated diols having two hydroxyl groups in the molecule are particularly preferable.

Among the aliphatic unsaturated carboxylic acids, aliphatic unsaturated dicarboxylic acids having two carboxyl groups in the molecule are particularly preferable.

One type of the aliphatic unsaturated compounds may be used alone, or two or more types thereof may be mixed for use.

The content (total content) of the aliphatic unsaturated compound in the electroless platinum plating solution of the present invention is not particularly limited, but is more preferably 0.01 g/L to 10 g/L, more preferably 0.05 g/L to 5 g/L, particularly preferably 0.1 g/L to 3 g/L with respect to the entire electroless platinum plating solution.

When the content is within the above range, the storage stability is easy to improve.

<N-Containing Heterocyclic Compound>

The electroless platinum plating solution of the present invention may contain an N-containing heterocyclic compound. The N-containing heterocyclic compound exhibits an action as a stabilizer in the plating solution, and maintains the performance of the plating solution when stored for a long period of time.

Examples of the N-containing heterocyclic compound include triazine, piperazine, piperidine, pyrazine, pyridine, pyrimidine, pyridazine, morpholine, and derivatives thereof.

"A derivative thereof" refers to a compound having the basic backbone of any compound in the above-mentioned compound group (for example, part or all of the hydrogen atoms in the ring are substituted; the ethylene group in the ring is substituted with a divalent linking group; etc.).

Examples of the substituent may include an alkyl group, an alkoxy group, a hydroxy group, an amino group and a halogen atom. Furthermore, the alkyl group or the alkoxy group may further have a substituent (hydroxy group, amino group, halogen atom, and the like).

Examples of the "divalent linking group" may include a carbonyl group and ether bond.

One type of the N-containing heterocyclic compounds may be used alone, or two or more types thereof may be mixed for use.

Furthermore, the N-containing heterocyclic compound and the above-mentioned aliphatic unsaturated compound may be used in combination.

The content (total content) of the N-containing heterocyclic compound in the electroless platinum plating solution of the present invention is not particularly limited, but is more preferably 0.01 g/L to 10 g/L, more preferably 0.05 g/L to 5 g/L, particularly preferably 0.1 g/L to 3 g/L with respect to the entire electroless platinum plating solution.

When the content is within the above range, the storage stability is easy to improve.

<Other Additives>

In the electroless platinum plating solution of the present invention, in addition to the above-mentioned components, a pH buffer for keeping the pH of the electroless platinum plating solution constant, a metal ion sequestering agent for eliminating the influence when impurity metals are mixed in the electroless platinum plating solution, a surfactant for improving the foam breaking of the electroless platinum plating solution, and the like may be appropriately contained for use, if necessary.

The pH buffer contained if necessary in the electroless platinum plating solution of the present invention is not particularly limited as long as it is a well-known buffer, but examples of the pH buffer preferably include inorganic acids such as boric acid and phosphoric acid; oxycarboxylic acids such as citric acid, tartaric acid and malic acid; and salts of these acids (potassium salts, sodium salts and ammonium salts).

One type of them may be used alone, or two or more types thereof may be mixed for use.

The content of the buffer in the electroless platinum plating solution of the present invention is not particularly limited, but is preferably 0.5 g/L to 200 g/L, particularly preferably 1 g/L to 100 g/L with respect to the entire electroless platinum plating solution.

When the content of the buffer in the electroless platinum plating solution is too low, the buffering effect may be difficult to be exhibited. On the other hand, when the content is too high, increase in buffering effect may not be observed, so that it may be uneconomical.

<pH of Electroless Platinum Plating Solution>

The pH of the electroless platinum plating solution of the present invention is essential to be 7 or more, preferably 9 or more, particularly preferably 11 or more. In addition, the pH is preferably 14 or less, particularly preferably 13.8 or less.

When the lower limit of the pH is more than or equal to the above, the effect achieved by adding the specific hydroxymethyl compound represented by the formula (1) (or a salt thereof) becomes sufficient.

The means for adjusting the pH to a desired value is not particularly limited. In order to increase the pH, potassium hydroxide, sodium hydroxide, and the like may be used. In order to decrease the pH, nitric acid, sulfuric acid, boric acid, phosphoric acid, and the like may be used.

[Solution for Initially Making Up Plating Solution]

The present invention also relates to a solution A for initially making up the above-mentioned electroless platinum plating solution, the solution A containing a soluble platinum salt and a specific hydroxymethyl compound represented by the above formula (1) or a salt thereof.

Since the specific hydroxymethyl compound represented by the formula (1) contained in the solution A is susceptible to oxidation under strongly alkaline conditions, the solution A is desirably weakly acidic or weakly alkaline. Specifically, the pH of the solution A is preferably 2.0 or more, particularly preferably 3.0 or more. In addition, the pH is preferably 11.0 or less, particularly preferably 9.0 or less.

In addition, the present invention also relates to a solution B for initially making up the above-mentioned electroless platinum plating solution, the solution B containing a complexing agent and a reducing agent that is any of a borohydride compound, an aminoborane compound, and a hydrazine compound.

The solution B may contain an aliphatic unsaturated compound or an N-containing heterocyclic compound, or both of them.

The solution B contains a reducing agent, so that it is preferably strongly alkaline to avoid self-decomposition of the reducing agent. Specifically, the pH of the solution B is preferably 12.0 or more, particularly preferably 13.5 or more.

One example of the method for preparing (initially making up) the electroless platinum plating solution of the present invention include a method for initially making up the above-mentioned electroless platinum plating solution of the present invention including individually preparing the solution A and the solution B, and mixing them, followed by dilution with water if necessary, as described in Examples below.

Doing in this way can achieve an effect of being capable of initially making up a plating solution directly in a plating tank (container) for a short time.

In other words, when an object to be plated is a small piece and is required to avoid contacting with other small pieces as much as possible, plating processing is performed in parallel by preparing a large number of small-sized plating tanks (containers) and introducing only one small piece substrate in each plating tank (container). In the case of such batch processing, it is necessary to quickly inject the plating solution into a large number of plating tanks (containers). Accordingly, it is essentially desirable to inject a preliminarily made up plating solution.

However, when the reduced-type electroless plating solution is initially made up in a managing tank other than the plating tank (container) and then left for a long time, the reducing agent may decompose due to air oxidation, resulting in decrease of the deposition rate. In addition, when the plating solution is dispensed into each plating tank (container) with a dispensing device, platinum may be reduced and deposited on a dispensing nozzle or the like, which may cause a problem that the injection amount is not constant.

Furthermore, at the mass production level, the timing of starting plating is often not constant every time due to the balance with respect to the previous step and the like, so that the plating solution is also required to be prepared in a timely manner. For these reasons, a direct initially made up manner in a plating tank (container) is often desirable.

It is possible to store the solution for initially making up for a long period (several months) by separating the solution A and the solution B of the present invention. Accordingly, it is possible to transfer the solution for initially making up to a plating tank (container) in a speedy and timely manner. Furthermore, the plating solution can be directly made up in a plating tank (container) by adding water as needed.

[Aqueous Solution for Preparing Electroless Platinum Plating Solution]

As mentioned above, soluble platinum salts are so expensive that storage in a state of being contained in an electroless platinum plating solution may be uneconomical, and various performances of a plating solution may be deteriorated when platinum is stored in the form of an aqueous solution. In addition, when the reducing agent (borohydride compound, aminoborane compound or hydrazine compound) is stored in the form of an aqueous solution for a long period of time, the reducing agent may decompose due to air oxidation.

For this reason, it is also preferable that the electroless platinum plating solution of the present invention be stored as "an aqueous solution for preparing an electroless platinum plating solution containing main components other than the soluble platinum salt and the reducing agent", and a user of the plating solution separately add a soluble platinum salt, reducing agent, and the like when performing platinum plating.

In other words, the present invention also relates to an aqueous solution for preparing the above-mentioned electroless platinum plating solution by adding a soluble platinum salt and a reducing agent that is any of a borohydride compound, an aminoborane compound, and a hydrazine compound.

The aqueous solution for preparing an electroless platinum plating solution of the present invention contains a complexing agent and a specific hydroxymethyl compound represented by the above formula (1) or a salt thereof.

The aqueous solution for preparing an electroless platinum plating solution of the present invention may further contain the above-mentioned aliphatic unsaturated compound and/or the above-mentioned N-containing heterocyclic compound, or both of them.

In order to prevent oxidation of the specific hydroxymethyl compound represented by the formula (1), the aqueous solution for preparing an electroless platinum plating solution is desirably weakly acidic or weakly alkaline. Specifically, the pH of the solution A is preferably 2.0 or more, particularly preferably 3.0 or more. In addition, the pH is preferably 11.0 or less, particularly preferably 9.0 or less.

The electroless platinum plating solution of the present invention can be prepared by adding a soluble platinum salt and a reducing agent that is any of a borohydride compound, an aminoborane compound, and a hydrazine compound to the aqueous solution for preparing an electroless platinum plating solution of the present invention, and adjusting the pH to 7 or more if necessary.

[Method for Producing Platinum Plating Film]

The present invention also relates to a method for producing a platinum plating film including immersing an object to be plated in an electroless platinum plating solution at 20 to 90° C. to form the platinum plating film, wherein the electroless platinum plating solution is initially made up by premixing the above-mentioned solution A and the above-mentioned solution B, or the electroless platinum plating solution is initially made up by adding a soluble platinum salt and a reducing agent that is any of a borohydride compound, an aminoborane compound, and a hydrazine compound to the above-mentioned aqueous solution for preparing an electroless platinum plating solution.

The temperature of the plating solution is preferably 30 to 80° C., particularly preferably 40 to 70° C.

When the temperature is too high, the stability of the plating solution may decrease, and when the temperature is too low, a practical plating speed may not be obtained.

Examples of the object to be plated may include a ceramic, glass and a metal.

In a case where the object to be plated is a non-conductive ceramic or glass, it is preferable to perform a catalyst treatment with palladium or platinum in advance using a publicly known technique.

According to the method for producing a platinum plating film of the present invention, pattern plating can be performed while the object to be plated is left standing after the object to be plated is immersed in an electroless platinum plating solution, without oscillation or rotation of the object to be plated.

For this reason, an expensive oscillating device is not required so that cost reduction is possible.

The bath load when the plating film is produced by the present invention is preferably 0.001 $dm^2/L$ or more and 1000 $dm^2/L$ or less, more preferably 0.01 $dm^2/L$ or more and 500 $dm^2/L$ or less, particularly preferably 0.02 $dm^2/L$ or more and 200 $dm^2/L$ or less.

In general, the larger the bath load, the higher the proportion of unstable substances during the plating reaction accounted for per volume of a plating solution, so the stability of the plating solution decreases. However, the plating solution of the present invention can have sufficiently high stability even in a high bath load state to perform plating without out-of-pattern deposition.

The plating time is preferably 5 minutes or more, particularly preferably 10 minutes or more. In addition, the plating time is preferably 360 minutes or less, particularly preferably 120 minutes or less.

When the plating time is within the above range, it is easy to form a plating film having a sufficient thickness, which is also advantageous in terms of cost.

[Platinum Plating Film]

The present invention also relates to a platinum plating film characterized by being formed on an object to be plated using the above-mentioned method for producing a platinum plating film.

The platinum plating film of the present invention is a high-purity platinum plating film that does not contain sulfur or heavy metals.

As shown in Examples described below, the platinum plating film obtained by plating using the plating solution of the present invention has no cracks or pinholes observed immediately after plating and after annealing, and thus is a good plating film with few defects.

In the plating film, cracks or pinholes have various sizes and shapes, and also cracks and pinholes appear at irregular positions in the plating film.

Therefore, it is impossible or nearly impractical to directly identify the platinum plating film obtained by plating using the plating solution of the present invention based on the structure or characteristics of the platinum plating film.

The action/principle how the electroless platinum plating solution of the present invention exhibits excellent stability and pattern plating properties is not clear, but the followings may be considered. However, the present invention is not limited to the range of the following effects.

The electroless platinum plating solution of the present invention is considered to have improved deposition selectivity because the specific hydroxymethyl compound represented by the formula (1) (or a salt thereof) is contained. This is considered to be due to the following reasons.

That is, it is conceivable that the surface of a substrate made of a metal oxide (-M-O-M-) such as a ceramic or glass adsorbs moisture in water to form surface hydroxyl groups (-M-OH), and the surface hydroxyl groups and the specific hydroxymethyl compound represented by the formula (1) are desorbed and adsorbed reversibly to each other via hydrogen bond, which protects the non-pattern (substrate) against abnormal deposition of platinum to improve the deposition selectivity. Accordingly, it is conceivable that platinum fine particles with poor adhesion that are abnormally deposited on the substrate are peeled off into the plating solution, and the route leading to decomposition of the plating solution is blocked, resulting in improvement of the stability.

EXAMPLES

Hereinafter, more specific description of the present invention will be made with reference to Examples. The present invention is not limited to these Examples, unless they depart from the spirit of the present invention.

Experimental Example 1 [Examples a1 to a5, Examples b1 to b5]

<Preparation of Solution A1>

A solution A1 for initially making up a plating solution (hereinafter sometimes referred to as "A1 solution") was obtained by dissolving a soluble platinum salt, a specific hydroxymethyl compound or other additive compounds and a pH buffer in deionized water so as to have the composition as shown in Table 1, and adjusting the pH to 7 with sodium hydroxide.

TABLE 1

| | | REAGENT NAME | CONCENTRATION |
|---|---|---|---|
| COMPONENTS OF A1 SOLUTION | SOLUBLE PLATINUM SALT | TETRAAMMINEPLATINUM (II) NITRATE | 7 g/L AS Pt |
| | pH BUFFER | CITRIC ACID | 20 g/L |
| | SPECIFIC HYDROXYMETHYL COMPOUND | EACH COMPOUND AS SHOWN IN TABLES 3 AND 4 | 0.04 mol/L |
| | OTHER ADDITIVE COMPOUNDS | EACH COMPOUND AS SHOWN IN TABLES 3 AND 4 | CONCENTRATION AS SHOWN IN TABLES 3 AND 4 |

<Preparation of Solution B1>

A solution B1 for initially making up a plating solution (hereinafter sometimes referred to as "B1 solution") was obtained by dissolving a reducing agent and a complexing agent in deionized water so as to have the composition as shown in Table 2, and adjusting the pH to 14 with sodium hydroxide.

TABLE 2

| | | REAGENT NAME | CONCENTRATION |
|---|---|---|---|
| COMPONENTS OF B1 SOLUTION | REDUCING AGENT | SODIUM BOROHYDRIDE | 18 g/L |
| | COMPLEXING AGENT | ETHYLENEDIAMINE | 400 mL/L |
| | pH ADJUSTOR | SODIUM HYDROXIDE | 100 g/L |

<Preparation of Electroless Platinum Plating Solution>

In a glass beaker, the A1 solution, the B1 solution and deionized water were mixed at a volume ratio of [A1 solution]:[B1 solution]:[deionized water]=1:1:8 to prepare electroless platinum plating solutions as shown in Table 3.

In mixing, deionized water, the A1 solution and the B1 solution were added in this order.

<Formation of Platinum Film for Evaluation>

It was assumed that all platinum in the plating solution was used up in batch processing so as to form a platinum film having a thickness of 1 μm on a pattern. Plating was performed in a stationary state. FIG. 1 shows a schematic diagram in a glass beaker when a platinum film for evaluation is formed by electroless plating processing without stirring.

A substrate for evaluation 3 was obtained by applying platinum catalyst paste JP1 (0.02 g/L of platinum content, water-based, manufactured by Japan Pure Chemical Co., Ltd.) with 80 μL brush only on the half of the surface of 25 mm×25 mm×1 mm alumina substrate (manufactured by Kyocera Corporation), followed by drying at 600° C., and patterning a catalyst layer 3*a* only on the half side of the surface of the alumina substrate.

Next, the substrate for evaluation 3 was immersed in a glass beaker 2 filled with an electroless platinum plating solution 1 (9.54 mL) shown in Table 3, and subjected to plating processing for 2 hours while being heated to 50° C. in a water bath. Plating was done without stirring, such that the substrate for evaluation 3 was maintained at the bottom of the glass beaker 2, and the activated surface (surface on which the catalyst layer 3*a* was patterned) was always maintained to be faced to the liquid level of the electroless platinum plating solution 1.

After the plating processing, the substrate for evaluation 3 was taken out, washed with water and dried with a dryer to produce an electroless platinum plating film.

<Evaluation Item>

[Stability of Plating Solution]

After plating for 2 hours, when the plating solution decomposed and black platinum was abnormally deposited (powdered or precipitated) in the plating solution, this was considered "decomposed" (x), and when no abnormal platinum deposition was observed, this was considered "good" (○).

[Plating Adhesion Efficiency]

When the stability of the plating solution was good (○), the platinum concentrations in the plating solution before and after plating were measured using an ICP emission analyzer ICPS-7510 (manufactured by Shimadzu Corporation), and the plating adhesion efficiency was calculated from the following Formula (X).

[Math. 1]

$$\text{PLATING ADHESION EFFICIENCY (\%)} = 100 \times \left[ 1 - \frac{\text{PLATINUM CONCENTRATION IN PLATING SOLUTION AFTER PLATING}}{\text{PLATINUM CONCENTRATION IN PLATING SOLUTION BEFORE PLATING}} \right] \quad \text{(X)}$$

[Patternability of Plating Film]

The substrate for evaluation 3 was visually observed, and when black or gray platinum was deposited on the entire area where the catalyst layer was not formed, this was considered "marked failure" (x), when black or gray platinum was deposited on a part of the area where the catalyst layer 3*a* was not formed, this was considered "failure" (Δ), and when black or gray platinum was not deposited on the area where the catalyst layer was not formed, and the white color was remained (the color of the alumina substrate was remained), this was considered "good" (○).

Table 3 shows the result of each evaluation item.

TABLE 3

| | | | | EXAMPLE a1 | EXAMPLE a2 | EXAMPLE a3 | EXAMPLE a4 | EXAMPLE a5 |
|---|---|---|---|---|---|---|---|---|
| COMPOSITION OF PLATING SOLUTION | A1 SOLUTION | SOLUBLE PLATINUM SALT | TETRAAMMINEPLATINUM (II) NITRATE (g/L) [AS Pt] | 0.7 | 0.7 | 0.7 | 0.7 | 0.7 |
| | | pH BUFFER | CITRIC ACID (g/L) | 2 | 2 | 2 | 2 | 2 |
| | | SPECIFIC HYDROXYMETHYL COMPOUND | DIHYDROXYACETONE DIMER (g/L) | 0.72 | — | — | — | — |
| | | | ERYTHROSE (g/L) | — | 0.48 | — | — | — |
| | | | XYLOSE (g/L) | — | — | 0.6 | — | — |
| | | | GLUCOSE (g/L) | — | — | — | 0.72 | — |
| | | | ASCORBIC ACID (g/L) | — | — | — | — | 0.7 |
| | | OTHER ADDITIVE COMPOUNDS | SODIUM m-NITROBENZENE SULFONATE (g/L) | — | — | — | — | — |
| | | | T1 (ppm) | — | — | — | — | — |
| | | | 80% AQUEOUS SOLUTION OF HYDRAZINE MONOHYDRATE (mL/L) | — | — | — | — | — |
| | B1 SOLUTION | REDUCING AGENT | SODIUM BOROHYDRIDE (g/L) | 1.8 | 1.8 | 1.8 | 1.8 | 1.8 |
| | | COMPLEXING AGENT | ETHYLENEDIAMINE (mL/L) | 40 | 40 | 40 | 40 | 40 |
| PLATING CONDITION | | | pH (25° C.) | 13.5 | 13.5 | 13.5 | 13.5 | 13.5 |
| | | | PLATING SOLUTION TEMPERATURE (° C.) | 50 | 50 | 50 | 50 | 50 |
| | | | STIRRING | NO | NO | NO | NO | NO |
| | | | PLATING TIME (min) | 120 | 120 | 120 | 120 | 120 |
| EVALUATION | | | STABILITY | ○ | ○ | ○ | ○ | ○ |
| | | | PLATING ADHESION EFFICIENCY (%) | 98.6 | 98.94 | 96.55 | 95.68 | 98.1 |
| | | | PATTERNABILITY | ○ | ○ | ○ | ○ | ○ |

| | | | | EXAMPLE b1 | EXAMPLE b2 | EXAMPLE b3 | EXAMPLE b4 | EXAMPLE b5 |
|---|---|---|---|---|---|---|---|---|
| COMPOSITION OF PLATING SOLUTION | A1 SOLUTION | SOLUBLE PLATINUM SALT | TETRAAMMINEPLATINUM (II) NITRATE (g/L) [AS Pt] | 0.7 | 0.7 | 0.7 | 0.7 | 0.7 |
| | | pH BUFFER | CITRIC ACID (g/L) | 2 | 2 | 2 | 2 | 2 |
| | | SPECIFIC HYDROXYMETHYL COMPOUND | DIHYDROXYACETONE DIMER (g/L) | — | — | — | — | — |
| | | | ERYTHROSE (g/L) | — | — | — | — | — |
| | | | XYLOSE (g/L) | — | — | — | — | — |
| | | | GLUCOSE (g/L) | — | — | — | — | — |
| | | | ASCORBIC ACID (g/L) | — | — | — | — | — |
| | | OTHER ADDITIVE COMPOUNDS | SODIUM m-NITROBENZENE SULFONATE (g/L) | 0.2 | — | 0.2 | — | 0.2 |
| | | | T1 (ppm) | — | 2 | 2 | — | — |
| | | | 80% AQUEOUS SOLUTION OF HYDRAZINE MONOHYDRATE (mL/L) | — | — | — | 3.6 | 3.6 |
| | B1 SOLUTION | REDUCING AGENT | SODIUM BOROHYDRIDE (g/L) | 1.8 | 1.8 | 1.8 | 1.8 | 1.8 |
| | | COMPLEXING AGENT | ETHYLENEDIAMINE (mL/L) | 40 | 40 | 40 | 40 | 40 |
| PLATING CONDITION | | | pH (25° C.) | 13.5 | 13.5 | 13.5 | 13.5 | 13.5 |
| | | | PLATING SOLUTION TEMPERATURE (° C.) | 50 | 50 | 50 | 50 | 50 |
| | | | STIRRING | NO | NO | NO | NO | NO |
| | | | PLATING TIME (min) | 120 | 120 | 120 | — | — |
| EVALUATION | | | STABILITY | x | ○ | ○ | x | x |
| | | | PLATING ADHESION EFFICIENCY (%) | — | 75.77 | 75.5 | — | — |
| | | | PATTERNABILITY | x | Δ | Δ | x | x |

Examples a1 to a4 relate to electroless platinum plating solutions containing one of the specific hydroxymethyl compounds belonging to sugar. For each solution, the plating time was 2 hours (120 minutes), the plating adhesion efficiency was 95% or more, and no out-of-pattern deposition or decomposition of the plating solution was confirmed.

Example a5 relates to an electroless platinum plating solution containing ascorbic acid among the specific hydroxymethyl compounds. The plating time was 2 hours (120 minutes), the plating adhesion efficiency was 95% or more, and no out-of-pattern deposition or decomposition of the plating solution was confirmed.

In Examples b1 to b3, m-nitrobenzenesulfonate or a thallium compound, or both of them was blended in place of the specific hydroxymethyl compound. For Example b1, out-of-pattern deposition and decomposition of the plating solution were confirmed. For Examples b2 and b3, although no decomposition of the plating solution was confirmed, deterioration of the plating adhesion efficiency and slight out-of-pattern deposition were confirmed.

In Example b4, hydrazine monohydrate was blended in place of the specific hydroxymethyl compound. For Example b4, decomposition of the plating solution was confirmed during temperature increase of the plating solution.

In Example b5, m-nitrobenzenesulfonate and hydrazine monohydrate were blended in place of the specific hydroxymethyl compound. For Example b5, decomposition of the plating solution was confirmed during temperature increase of the plating solution.

As described above, according to the electroless platinum plating solution of the present invention, it can be seen that adding the specific hydroxymethyl compound exhibits excellent patternability without deteriorating the deposition efficiency (plating adhesion efficiency).

<Observation of Platinum Plating Film>

The platinum plating films formed on the pattern by Example a4 and Example b2 were observed from above using a field emission scanning electron microscope (S-4300, manufactured by Hitachi High-Technologies Corporation). The platinum plating film was observed immediately after plating (as plated) and after annealing processing.

The annealing processing was performed for 1 hour using a small box furnace (KBF422N1, manufactured by Koyo Thermo Systems Co., Ltd.) while being heated to 400° C. in the atmosphere.

The observation results of the platinum plating films are shown in FIG. 5.

As shown in FIG. 5, it can be seen that the platinum plating film obtained by the method for producing a platinum plating film of the present invention has no cracks or pinholes observed immediately after plating and after annealing, and thus is a good plating film with few defects.

On the other hand, as shown in FIG. 6, the platinum plating film obtained from the electroless platinum plating solution containing no specific hydroxymethyl compound but containing thallium (Tl) has pin holes observed after annealing.

Experimental Example 2 [Examples c1 to c4, Examples d1 to d3]

<Preparation of Electroless Platinum Plating Solution>

In the same manner as in Experimental Example 1, the A1 solution and B1 solution were prepared. In addition, in the same manner as in Experimental Example 1, the A1 solution, the B1 solution and deionized water were mixed to produce electroless platinum plating solutions shown in Table 4.

<Formation of Platinum Film for Evaluation>

It was assumed that all platinum in the plating solution was used up in batch processing so as to form a platinum film having a thickness of 1 μm on a pattern. Plating was performed with stirring. FIG. 2 shows a schematic diagram in a glass beaker when a platinum film for evaluation is formed by electroless plating processing with stirring.

A substrate for evaluation 3 was obtained by applying platinum catalyst paste JP1 (0.02 g/L of platinum content, water-based, manufactured by Japan Pure Chemical Co., Ltd.) with 52 μL brush only on the lower half of the outer circumference of 3 mm×50 mm×1 mm alumina substrate (manufactured by Kyocera Corporation), followed by drying at 600° C. with leaned and the coated side facing down, and patterning a catalyst layer 3*a* only on the lower half side of the alumina substrate. The pattern area was about 0.02 $dm^2$.

Next, the substrate for evaluation 3 was immersed in a glass beaker 2 filled with an electroless platinum plating solution 1 (6.2 mL) shown in Table 4, and subjected to plating processing for 2 hours while being heated to 50° C. in a water bath. Plating was performed with stirring at 200 rpm using a stirrer 4, and the substrate for evaluation 3 was kept in a state of not contacting with the glass beaker 2 or the stirrer 4 by hanging the substrate for evaluation 3.

After the plating processing, the substrate for evaluation 3 was taken out, washed with water and dried with a dryer to produce an electroless platinum plating film.

<Evaluation Item>

In the same manner as in Experimental Example 1, the stability of the plating solution, the plating adhesion efficiency and the patternability of the plating film were evaluated.

Table 4 shows the result of each evaluation item.

TABLE 4

| | | | | EXAMPLE c1 | EXAMPLE c2 | EXAMPLE c3 | EXAMPLE c4 | EXAMPLE d1 | EXAMPLE d2 | EXAMPLE d3 |
|---|---|---|---|---|---|---|---|---|---|---|
| COMPOSITION OF PLATING SOLUTION | A1 SOLUTION | SOLUBLE PLATINUM SALT | TETRAAMMINEPLATINUM (II) NITRATE (g/L) [AS Pt] | 0.7 | 0.7 | 0.7 | 0.7 | 0.7 | 0.7 | 0.7 |
| | | pH BUFFER | CITRIC ACID (g/L) | 2 | 2 | 2 | 2 | 2 | 2 | 2 |
| | | SPECIFIC HYDROXYMETHYL COMPOUND | GLUCOSE (g/L) | 0.72 | — | — | — | — | — | — |
| | | | GALACTOSE (g/L) | — | 0.72 | — | — | — | — | — |
| | | | MALTOSE (g/L) | — | — | 1.37 | — | — | — | — |
| | | | MALTOTRIOSE (g/L) | — | — | — | 2.02 | — | — | — |
| | | OTHER ADDITIVE COMPOUNDS | SODIUM m-NITROBENZENE SULFONATE (g/L) | — | — | — | — | 0.2 | — | 0.2 |
| | | | Tl (ppm) | — | — | — | — | — | 2 | 2 |
| | B1 SOLUTION | REDUCING AGENT | SODIUM BOROHYDRIDE (g/L) | 1.8 | 1.8 | 1.8 | 1.8 | 1.8 | 1.8 | 1.8 |
| | | COMPLEXING AGENT | ETHYLENEDIAMINE (mL/L) | 40 | 40 | 40 | 40 | 40 | 40 | 40 |

TABLE 4-continued

| | | EXAMPLE c1 | EXAMPLE c2 | EXAMPLE c3 | EXAMPLE c4 | EXAMPLE d1 | EXAMPLE d2 | EXAMPLE d3 |
|---|---|---|---|---|---|---|---|---|
| PLATING CONDITION | pH (25° C.) | 13.5 | 13.5 | 13.5 | 13.5 | 13.5 | 13.5 | 13.5 |
| | PLATING SOLUTION TEMPERATURE (° C.) | 50 | 50 | 50 | 50 | 50 | 50 | 50 |
| | STIRRING (rpm) | 200 | 200 | 200 | 200 | 200 | 200 | 200 |
| | PLATING TIME (min) | 120 | 120 | 120 | 120 | 120 | 120 | 120 |
| EVALUATION | STABILITY | ○ | ○ | ○ | ○ | x | ○ | ○ |
| | PLATING ADHESION EFFICIENCY (%) | 98.64 | 98.78 | 98.69 | 98.69 | — | 97.45 | 93.09 |
| | PATTERNABILITY | ○ | ○ | ○ | ○ | x | x | x |

Examples c1 to c4 relate to electroless platinum plating solutions containing one of the specific hydroxymethyl compounds belonging to sugar. For each solution, the plating time was 2 hours (120 minutes), the plating adhesion efficiency was 98% or more, and no out-of-pattern deposition or decomposition of the plating solution was confirmed.

In addition, it was confirmed that the deposition efficiency (plating adhesion efficiency) tended to be improved as compared with Examples a1 to a5 without stirring.

In Examples d1 to d3, m-nitrobenzenesulfonate or a thallium compound, or both of them was blended in place of the specific hydroxymethyl compound. For Example d1, out-of-pattern deposition and decomposition of the plating solution were confirmed. For Examples d2 and d3, although no decomposition of the plating solution was confirmed, out-of-pattern deposition was confirmed.

In addition, the deposition efficiency (plating adhesion efficiency) was improved and out-of-pattern deposition was easily to occur as compared with Examples b1 to b3 without stirring.

As described above, according to the electroless platinum plating solution of the present invention, adding the specific hydroxymethyl compound can suppress the deterioration of out-of-pattern deposition due to solution stirring, and only the deposition efficiency (plating adhesion efficiency) can be improved.

Experimental Example 3 [Examples e1 to e3, Examples f1 to f7]

<Preparation of Solution A2>

A solution A2 for initially making up a plating solution (hereinafter sometimes referred to as "A2 solution") was obtained by dissolving a soluble platinum salt, a specific hydroxymethyl compound or other additive compounds and a pH buffer in deionized water so as to have the composition as shown in Table 5, and adjusting the pH to 7 with sodium hydroxide.

TABLE 5

| | | REAGENT NAME | CONCENTRATION |
|---|---|---|---|
| COMPONENTS OF A2 SOLUTION | SOLUBLE PLATINUM SALT | EACH COMPOUND AS SHOWN IN TABLE 7 | 10 g/L AS Pt |
| | pH BUFFER | CITRIC ACID | 2 g/L |
| | SPECIFIC HYDROXYMETHYL COMPOUND | EACH COMPOUND AS SHOWN IN TABLE 7 | 0.0284 mol/L |
| | OTHER ADDITIVE COMPOUNDS | EACH COMPOUND AS SHOWN IN TABLE 7 | CONCENTRATION AS SHOWN IN TABLE 7 |

<Preparation of Solution B2>

A solution B2 for initially making up a plating solution (hereinafter sometimes referred to as "B2 solution") was obtained by dissolving a reducing agent and a complexing agent in deionized water so as to have the composition as shown in Table 6, and adjusting the pH to 14 with sodium hydroxide.

TABLE 6

| | | REAGENT NAME | CONCENTRATION |
|---|---|---|---|
| COMPONENTS OF B2 SOLUTION | REDUCING AGENT | SODIUM BOROHYDRIDE | 8 g/L |
| | COMPLEXING AGENT | ETHYLENEDIAMINE | 500 mL/L |
| | pH ADJUSTOR | SODIUM HYDROXIDE | 20 g/L |

<Preparation of Electroless Platinum Plating Solution>

In a glass beaker, the A2 solution and the B2 solution were mixed at a volume ratio of [A2 solution]:[B2 solution]=1:1 to prepare electroless platinum plating solutions as shown in Table 7.

In mixing, the A2 solution and the B2 solution were added in this order.

<Formation of Platinum Film for Evaluation>

Assuming continuous plating processing, it was assumed that platinum in the plating solution was not used up so as to form a platinum plating film having a thickness of 1 μm on a pattern. FIG. 3 shows a schematic diagram in a glass beaker when a platinum film for evaluation is formed by electroless plating processing without stirring.

A substrate for evaluation 3 was obtained by applying platinum catalyst paste JP1 (0.02 g/L of platinum content, water-based, manufactured by Japan Pure Chemical Co., Ltd.) with 80 μL brush only on the half of the surface of 25 mm×25 mm×1 mm alumina substrate (manufactured by Kyocera Corporation), followed by drying at 600° C., and patterning a catalyst layer 3*a* only on the half side of the surface of the alumina substrate. The pattern area was about 0.0312 $dm^2$.

Next, the substrate for evaluation 3 was immersed in a glass beaker 2 filled with an electroless platinum plating solution 1 (10 mL) shown in Table 7, and subjected to plating processing for the time as shown in Table 7 while being heated to the temperature as shown in Table 7 in a water bath. Plating was performed without stirring, and the substrate for evaluation 3 was kept in a state of not contacting with the glass beaker 2 by hanging the substrate for evaluation 3.

After the plating processing, the substrate for evaluation 3 was taken out, washed with water and dried with a dryer to produce an electroless platinum plating film.

<Evaluation Item>

[Stability of Plating Solution/Patternability of Plating Film]

Evaluation was performed in the same manner as in Experimental Example 1.

[Plating Film Thickness]

An X-ray fluorescence analyzer SFT-9255 (manufactured by Seiko Instruments Inc.) was used for the measurement. The pattern was divided into nine equal parts in a grid pattern, and the average value of nine points measured near the center was defined as the plating film thickness.

Table 7 shows the result of each evaluation item.

TABLE 7

| | | | | EXAMPLE e1 | EXAMPLE e2 | EXAMPLE e3 | EXAMPLE f1 | EXAMPLE f2 |
|---|---|---|---|---|---|---|---|---|
| COMPOSITION OF PLATING SOLUTION | A2 SOLUTION | SOLUBLE PLATINUM SALT | TETRAAMMINEPLATINUM (II) NITRATE (g/L) [AS Pt] | 5 | 5 | 5 | 5 | 5 |
| | | | BIS-(ETHYLENEDIAMINE) PLATINUM NITRATE (g/L) [AS Pt] | — | — | — | — | — |
| | | pH BUFFER SPECIFIC HYDROXYMETHYL COMPOUND | CITRIC ACID (g/L) | 1 | 1 | 1 | 1 | 1 |
| | | | GLUCOSE (g/L) | 0.72 | — | — | — | — |
| | | | GALACTOSE (g/L) | — | 0.72 | — | — | — |
| | | | LACTOSE (g/L) | — | — | 1.37 | — | — |
| | | OTHER ADDITIVE COMPOUNDS | SODIUM m-NITROBENZENE SULFONATE (g/L) | — | — | — | — | — |
| | | | T1 (ppm) | — | — | — | — | — |
| | | | 80% AQUEOUS SOLUTION OF HYDRAZINE MONOHYDRATE (mL/L) | — | — | — | — | — |
| | B2 SOLUTION | REDUCING AGENT | SODIUM BOROHYDRIDE (g/L) | 4 | 4 | 4 | 4 | 4 |
| | | COMPLEXING AGENT | ETHYLENEDIAMINE (mL/L) | 250 | 250 | 250 | 250 | 250 |
| PLATING CONDITION | | | pH (25° C.) | 13.8 | 13.8 | 13.8 | 13.8 | 13.8 |
| | | | PLATING SOLUTION TEMPERATURE (° C.) | 50 | 50 | 50 | 50 | 30 |
| | | | STIRRING (rpm) | NO | NO | NO | NO | NO |
| | | | PLATING TIME (min) | 40 | 40 | 40 | 40 | 40 |
| EVALUATION | | | STABILITY | ○ | ○ | ○ | x | ○ |
| | | | PLATING FILM THICKNESS (μm) | 1.2 | 1.2 | 1.1 | — | 0.3 |
| | | | PATTERNABILITY | ○ | ○ | ○ | x | x |

| | | | | EXAMPLE f3 | EXAMPLE f4 | EXAMPLE f5 | EXAMPLE f6 | EXAMPLE f7 |
|---|---|---|---|---|---|---|---|---|
| COMPOSITION OF PLATING SOLUTION | A2 SOLUTION | SOLUBLE PLATINUM SALT | TETRAAMMINEPLATINUM (II) NITRATE (g/L) [AS Pt] | — | — | — | 5 | 5 |
| | | | BIS-(ETHYLENEDIAMINE) | 5 | 5 | 5 | — | — |

TABLE 7-continued

| | | | | | | | |
|---|---|---|---|---|---|---|---|
| | | PLATINUM NITRATE (g/L) [AS Pt] | | | | | |
| | pH BUFFER | CITRIC ACID (g/L) | 1 | 1 | 1 | 1 | 1 |
| | SPECIFIC HYDROXYMETHYL COMPOUND | GLUCOSE (g/L) | — | — | — | — | — |
| | | GALACTOSE (g/L) | — | — | — | — | — |
| | | LACTOSE (g/L) | — | — | — | — | — |
| | OTHER ADDITIVE COMPOUNDS | SODIUM m-NITROBENZENE SULFONATE (g/L) | — | — | 5 | — | 0.1 |
| | | T1 (ppm) | 5 | 5 | 5 | — | — |
| | | 80% AQUEOUS SOLUTION OF HYDRAZINE MONOHYDRATE (mL/L) | — | — | — | 3.0 | 3.0 |
| B2 SOLUTION | REDUCING AGENT | SODIUM BOROHYDRIDE (g/L) | 5 | 5 | 5 | 2.4 | 2.4 |
| | COMPLEXING AGENT | ETHYLENEDIAMINE (mL/L) | 20 | 20 | 20 | 55 | 55 |
| PLATING CONDITION | | pH (25° C.) | 13.5 | 13.5 | 13.5 | 13.8 | 13.8 |
| | | PLATING SOLUTION TEMPERATURE (° C.) | 35 | 50 | 50 | 50 | 50 |
| | | STIRRING (rpm) | NO | NO | NO | NO | NO |
| | | PLATING TIME (min) | 40 | 40 | 40 | 40 | 40 |
| EVALUATION | | STABILITY | ○ | x | x | x | x |
| | | PLATING FILM THICKNESS (μm) | 0.3 | — | — | — | — |
| | | PATTERNABILITY | ○ | x | x | x | x |

Examples e1 to e3 relate to electroless platinum plating solutions containing one of the specific hydroxymethyl compounds belonging to sugar in a state where the soluble platinum salt (platinum complex) is at a high concentration. For each solution, the plating time was 40 minutes, the plating film thickness was 1.1 μm or more, and no out-of-pattern deposition or decomposition of the plating solution was confirmed.

Examples f1 and f2 relate to electroless platinum plating solutions containing no specific hydroxymethyl compound. When plating was performed at 50° C. for 40 minutes, decomposition of the plating solution was confirmed, and out-of-pattern deposition was confirmed. In addition, when plating was performed at the plating solution temperature lowered to 30° C., although decomposition of the plating solution was not confirmed, the plating film thickness was as thin as 0.3 μm and out-of-pattern deposition was confirmed.

In Examples f3 to f5, m-nitrobenzenesulfonate or a thallium compound, or both of them was blended in place of the specific hydroxymethyl compound. For Example f3, decomposition of the plating solution or out-of-pattern deposition was not confirmed, but the plating film thickness was as thin as 0.3 μm. For Examples f4 and f5, attempts were made to increase the plating speed by increasing the plating temperature, but decomposition of the plating solution was confirmed.

In Example f6, hydrazine monohydrate was blended in place of the specific hydroxymethyl compound. For Example f6, decomposition of the plating solution was confirmed during plating temperature increase.

In Example f7, hydrazine monohydrate and m-nitrobenzenesulfonate were blended in place of the specific hydroxymethyl compound. For Example f7, decomposition of the plating solution was confirmed during plating.

As described above, according to the electroless platinum plating solution of the present invention, it can be seen that even when the platinum complex concentration in the solution is increased, the stability is excellent, high-speed plating is possible, and an excellent patternability is provided without lowering the plating speed due to addition of the specific hydroxymethyl compound.

Experimental Example 4 [Examples g1 to g9, Examples h1 to h2]

<Preparation of Solution A3>

A solution A3 for initially making up a plating solution (hereinafter sometimes referred to as "A3 solution") was obtained by dissolving a soluble platinum salt, a specific hydroxymethyl compound and a pH buffer in deionized water so as to have the composition as shown in Table 8, and adjusting the pH to 7 with sodium hydroxide.

TABLE 8

| | | REAGENT NAME | CONCENTRATION |
|---|---|---|---|
| COMPONENTS OF A3 SOLUTION | SOLUBLE PLATINUM SALT | TETRAAMMINEPLATINUM (II) NITRATE | 7 g/L AS Pt |
| | pH BUFFER | CITRIC ACID | 20 g/L |
| | SPECIFIC HYDROXYMETHYL COMPOUND | EACH COMPOUND AS SHOWN IN TABLE 10 | 0.04 mol/L |

<Preparation of Solution B3>

A solution B3 for initially making up a plating solution (hereinafter sometimes referred to as "B3 solution") was obtained by dissolving a reducing agent, a complexing agent and a stabilizer in deionized water so as to have the composition as shown in Table 9, and adjusting the pH to 14 with sodium hydroxide.

TABLE 9

| | | REAGENT NAME | CONCENTRATION |
|---|---|---|---|
| COMPONENTS OF B3 SOLUTION | REDUCING AGENT | SODIUM BOROHYDRIDE | 18 g/L |
| | COMPLEXING AGENT | ETHYLENEDIAMINE | 400 mL/L |
| | STABILIZER | EACH COMPOUND AS SHOWN IN TABLE 10 | 0.045 mol/L |
| | pH ADJUSTOR | SODIUM HYDROXIDE | 100 g/L |

<Preparation of Electroless Platinum Plating Solution>

In a glass beaker, the A3 solution, the B3 solution and deionized water were mixed at a volume ratio of [A3 solution]:[B3 solution]:[deionized water]=1:1:8 to prepare electroless platinum plating solutions as shown in Table 10.

In mixing, deionized water, the A3 solution and the B3 solution were added in this order.

<Formation of Platinum Film for Evaluation>

In the same manner as in Experimental Example 1, the electroless platinum plating film was obtained, except that each of the prepared electroless platinum plating solutions was stored at room temperature (25° C.) for 24 hours before plating processing.

<Evaluation Item>

In the same manner as in Experimental Example 1, the stability of the plating solution, the plating adhesion efficiency and the patternability of the plating film were evaluated when the plating solution after long-term (24 hours) storage was used.

Table 10 shows the result of each evaluation item.

TABLE 10

| | | | | EXAMPLE g1 | EX-AMPLE g2 | EX-AMPLE g3 | EX-AMPLE g4 | EX-AMPLE g5 | EX-AMPLE g6 |
|---|---|---|---|---|---|---|---|---|---|
| COMPOSITION OF PLATING SOLUTION | A3 SOLUTION | SOLUBLE PLATINUM SALT | TETRA-AMMINEPLATINUM (II) NITRATE (g/L) [AS Pt] | 0.7 | 0.7 | 0.7 | 0.7 | 0.7 | 0.7 |
| | | pH BUFFER | CITRIC ACID (g/L) | 2 | 2 | 2 | 2 | 2 | 2 |
| | | SPECIFIC HYDROXY-METHYL COMPOUND | GLUCOSE (g/L) | 0.72 | 0.72 | 0.72 | 0.72 | 0.72 | 0.72 |
| | | | ASCORBIC ACID (g/L) | — | — | — | — | — | — |
| | B3 SOLUTION | REDUCING AGENT | SODIUM BOROHYDRIDE (g/L) | 1.8 | 1.8 | 1.8 | 1.8 | 1.8 | 1.8 |
| | | COMPLEXING AGENT | ETHYLENEDIAMINE (mL/L) | 40 | 40 | 40 | 40 | 40 | 40 |
| | | STABILIZER | PYRIDINE (g/L) | 0.36 | — | — | — | — | — |
| | | | PYRAZINE (g/L) | — | 0.36 | — | — | — | — |
| | | | 1,3,5-TRIAZINE (g/L) | — | — | 0.37 | — | — | — |
| | | | MELAMINE (g/L) | — | — | — | 0.57 | — | — |
| | | | PYRIMIDINE (g/L) | — | — | — | — | 0.36 | — |
| | | | 2,4,6-TRIAMINO-PYRIMIDINE (g/L) | — | — | — | — | — | 0.56 |
| | | | CYTOSINE (g/L) | — | — | — | — | — | — |
| | | | BUTENEDIOL (g/L) | — | — | — | — | — | — |
| | | | MALEIC ACID (g/L) | — | — | — | — | — | — |
| PLATING CONDITION | | | pH (25° C.) | 13.5 | 13.5 | 13.5 | 13.5 | 13.5 | 13.5 |
| | | | PLATING SOLUTION TEMPERATURE (° C.) | 50 | 50 | 50 | 50 | 50 | 50 |
| | | | STIRRING | NO | NO | NO | NO | NO | NO |
| | | | PLATING TIME (min) | 120 | 120 | 120 | 120 | 120 | 120 |
| EVALUATION | | | STABILITY (AFTER LONG-TERM STORAGE) | ○ | ○ | ○ | ○ | ○ | ○ |
| | | | PLATING ADHESION EFFICIENCY (%) (AFTER LONG-TERM STORAGE) | 95.21 | 95.05 | 95.41 | 95.37 | 95.61 | 95.72 |
| | | | PATTERNABILITY (AFTER LONG-TERM STORAGE) | ○ | ○ | ○ | ○ | ○ | ○ |

TABLE 10-continued

| | | | | EX-AMPLE g7 | EX-AMPLE g8 | EX-AMPLE g9 | EX-AMPLE h1 | EX-AMPLE h2 |
|---|---|---|---|---|---|---|---|---|
| COMPO-SITION OF PLATING SO-LUTION | A3 SOLUTION | SOLUBLE PLATINUM SALT | TETRA-AMMINEPLATINUM (II) NITRATE (g/L) [AS Pt] | 0.7 | 0.7 | 0.7 | 0.7 | 0.7 |
| | | pH BUFFER | CITRIC ACID (g/L) | 2 | 2 | 2 | 2 | 2 |
| | | SPECIFIC HYDROXY-METHYL COMPOUND | GLUCOSE (g/L) | 0.72 | 0.72 | 0.72 | 0.72 | — |
| | | | ASCORBIC ACID (g/L) | — | — | — | — | 0.7 |
| | B3 SOLUTION | REDUCING AGENT | SODIUM BOROHYDRIDE (g/L) | 1.8 | 1.8 | 1.8 | 1.8 | 1.8 |
| | | COMPLEXING AGENT | ETHYLENEDIAMINE (mL/L) | 40 | 40 | 40 | 40 | 40 |
| | | STABILIZER | PYRIDINE (g/L) | — | — | — | — | — |
| | | | PYRAZINE (g/L) | — | — | — | — | — |
| | | | 1,3,5-TRIAZINE (g/L) | — | — | — | — | — |
| | | | MELAMINE (g/L) | — | — | — | — | — |
| | | | PYRIMIDINE (g/L) | — | — | — | — | — |
| | | | 2,4,6-TRIAMINO-PYRIMIDINE (g/L) | — | — | — | — | — |
| | | | CYTOSINE (g/L) | 0.5 | — | — | — | — |
| | | | BUTENEDIOL (g/L) | — | 0.4 | — | — | — |
| | | | MALEIC ACID (g/L) | — | — | 0.52 | — | — |
| | PLATING CONDITION | | pH (25° C.) | 13.5 | 13.5 | 13.5 | 13.5 | 13.5 |
| | | | PLATING SOLUTION TEMPERATURE (° C.) | 50 | 50 | 50 | 50 | 50 |
| | | | STIRRING | NO | NO | NO | NO | NO |
| | | | PLATING TIME (min) | 120 | 120 | 120 | 120 | 120 |
| | EVALUATION | | STABILITY (AFTER LONG-TERM STORAGE) | ○ | ○ | ○ | x | x |
| | | | PLATING ADHESION EFFICIENCY (%) (AFTER LONG-TERM STORAGE) | 96.1 | 95.81 | 95.74 | 98.79 | 99.12 |
| | | | PATTERNABILITY (AFTER LONG-TERM STORAGE) | ○ | ○ | ○ | x | x |

Examples g1 to g7 relate to electroless platinum plating solutions containing an N-containing heterocyclic compound as a stabilizer and further containing glucose as a specific hydroxymethyl compound. For each solution, the plating time was 2 hours (120 minutes), the plating adhesion efficiency was 95% or more, and no out-of-pattern deposition or decomposition of the plating solution was confirmed.

Examples g8 to g9 relate to electroless platinum plating solutions containing an aliphatic unsaturated compound as a stabilizer and further containing glucose as a specific hydroxymethyl compound. For each solution, the plating time was 2 hours (120 minutes), the plating adhesion efficiency was 95% or more, and no out-of-pattern deposition or decomposition of the plating solution was confirmed.

Examples h1 and h2 relate to electroless platinum plating solutions not containing a stabilizer but containing a specific hydroxymethyl compound. For each solution, the plating time was 2 hours (120 minutes), and out-of-pattern deposition and decomposition of the plating solution were confirmed.

As described above, it can be seen that even when left in the state of plating solution for a long time, the electroless platinum plating solution of the present invention exhibits excellent long-term storage by adding a stabilizer without deteriorating the patternability and the stability.

Example 5 [Examples i1 to i6, Examples j1 to j6, Example k1, Example l1]

<Preparation of Solution A4>

A solution A4 for initially making up a plating solution (hereinafter sometimes referred to as "A4 solution") was obtained by dissolving a soluble platinum salt, a specific hydroxymethyl compound and a pH buffer in deionized water so as to have the composition as shown in Table 11, and adjusting the pH to 7 with sodium hydroxide.

TABLE 11

| | | REAGENT NAME | CONCENTRATION |
|---|---|---|---|
| COMPONETS OF A4 SOLUTION | SOLUBLE PLATINUM SALT | TETRAAMMINEPLATINUM (II) CITRATE | 2 g/L AS Pt |
| | pH BUFFER | AMMONIUM CITRATE | 20 g/L |
| | SPECIFIC | EACH COMPOUND | 0.00278 mol/L |

TABLE 11-continued

| | REAGENT NAME | CONCENTRATION |
|---|---|---|
| HYDROXYMETHYL COMPOUND | AS SHOWN IN TABLE 13 | |

<Preparation of Solution B4>

A solution B4 for initially making up a plating solution (hereinafter sometimes referred to as "B4 solution") was obtained by dissolving a reducing agent, a complexing agent and a stabilizer in deionized water so as to have the composition as shown in Table 12, and adjusting the pH to 14 with sodium hydroxide.

TABLE 12

| | | REAGENT NAME | CONCENTRATION |
|---|---|---|---|
| COMPONETS OF B4 SOLUTION | REDUCING AGENT | HYDRAZINE MONOHYDRATE | 2.8 mL/L |
| | COMPLEXING AGENT | 25% AMMONIUM SOLUTION | CONCENTRATION AS SHOWN IN TABLE 13 |
| | | ETHYLENEDIAMINE | CONCENTRATION AS SHOWN IN TABLE 13 |
| | STABILIZER | EACH COMPOUND AS SHOWN IN TABLE 13 | 0.045 mol/L |
| | pH ADJUSTOR | SODIUM HYDROXIDE | 6.5 g/L |

<Preparation of Electroless Platinum Plating Solution>

In a glass beaker, the A4 solution, the B4 solution and deionized water were mixed at a volume ratio of [A4 solution]:[B4 solution]:[deionized water]=1:1:8 to prepare electroless platinum plating solutions as shown in Table 13.

In mixing, deionized water, the A4 solution and the B4 solution were added in this order.

<Formation of Platinum Film for Evaluation 1>

It was assumed that all platinum in the plating solution was used up in batch processing so as to form a platinum film having a thickness of 1 μm on a pattern. Plating was performed with stirring. FIG. 4 shows a schematic diagram in a glass beaker when a platinum film for evaluation is formed by electroless plating processing with stirring.

A substrate for evaluation 3 was obtained by applying platinum catalyst paste JP1 (0.02 g/L of platinum content, water-based, manufactured by Japan Pure Chemical Co., Ltd.) with 80 μL brush only on the half of the surface of 25 mm×25 mm×1 mm alumina substrate (manufactured by Kyocera Corporation), followed by drying at 600° C., and patterning a catalyst layer 3*a* only on the half side of the surface of the alumina substrate. The pattern area was about 0.0312 $dm^2$.

Next, the substrate for evaluation 3 was immersed in a glass beaker 2 filled with an electroless platinum plating solution 1 (33.4 mL) shown in Table 13, and subjected to plating processing for 2 hours while being heated to 50° C. in a water bath. Plating was performed with stirring at 200 rpm using a stirrer 4, and the substrate for evaluation 3 was kept in a state of not contacting with the glass beaker 2 or the stirrer 4 by hanging the substrate for evaluation 3.

After the plating processing, the substrate for evaluation 3 was taken out, washed with water and dried with a dryer to produce an electroless platinum plating film.

<Formation of Platinum Film for Evaluation 2>

In the same manner as in <Formation of platinum film for evaluation 1>, an electroless platinum plating film was obtained, except that each of the prepared electroless platinum plating solutions was stored at room temperature (25° C.) for 24 hours before plating processing.

<Evaluation Item>

In the same manner as in Experimental Example 1, for each of the case where the prepared plating solution was immediately subjected to plating processing (the case of <Formation of platinum film for evaluation 1>) and the case where the prepared plating solution was subjected to plating processing after long-term (24 hours) storage (the case of <Formation of platinum film for evaluation 2>), the stability of the plating solution, the plating adhesion efficiency and the patternability of the plating film were evaluated.

Table 13 shows the result of each evaluation item.

TABLE 13

| | | | | EXAMPLE i1 | EXAMPLE i2 | EXAMPLE i3 | EXAMPLE i4 | EXAMPLE i5 | EXAMPLE i6 | EXAMPLE j1 |
|---|---|---|---|---|---|---|---|---|---|---|
| COMPOSITION OF PLATING SOLUTION | A4 SOLUTION | SOLUBLE PLATINUM SALT | TETRAAMMINEPLATINUM (II) CITRATE (g/L) [AS Pt] | 0.2 | 0.2 | 0.2 | 0.2 | 0.2 | 0.2 | 0.2 |
| | | pH BUFFER | AMMONIUM CITRATE (g/L) | 2 | 2 | 2 | 2 | 2 | 2 | 2 |
| | | SPECIFIC HYDROXYMETHYL | GLUCOSE (g/L) | 0.05 | — | — | — | — | — | 0.05 |
| | | | MANNOSE (g/L) | — | 0.05 | — | — | — | — | — |
| | | | FRUCTOSE (g/L) | — | — | 0.05 | — | — | — | — |

TABLE 13-continued

| | | | | | | | | | | |
|---|---|---|---|---|---|---|---|---|---|---|
| | | COM-POUND | LACTOSE MONOHYDRATE (g/L) | — | — | — | 0.1 | — | — | — |
| | | | CELLOBIOSE (g/L) | — | — | — | — | 0.095 | — | — |
| | | | ACARBOSE (g/L) | — | — | — | — | — | 0.048 | — |
| | B4 SO-LUTION | REDUCING AGENT | HYDRAZINE MONOHYDRATE (mL/L) | 0.28 | 0.28 | 0.28 | 0.28 | 0.28 | 0.28 | 0.28 |
| | | COM-PLEXING AGENT | 25% AMMONIUM SOLUTION (mL/L) | 1 | 1 | 1 | 1 | 1 | 1 | 1 |
| | | | ETHYLENEDIAMINE (mL/L) | — | — | — | — | — | — | — |
| | | STA-BILIZER | 2-HYDROXYPYRIDINE (g/L) | — | — | — | — | — | — | 0.43 |
| | | | 2-METHYLPYRAZINE (g/L) | — | — | — | — | — | — | — |
| | | | 3-AMINOPYRIDAZINE (g/L) | — | — | — | — | — | — | — |
| | | | URACIL (g/L) | — | — | — | — | — | — | — |
| | | | BUTYNEDIOL (g/L) | — | — | — | — | — | — | — |
| | | | FUMARIC ACID (g/L) | — | — | — | — | — | — | — |
| PLATING CONDITION | | | pH (25° C.) | 12.5 | 12.5 | 12.5 | 12.5 | 12.5 | 12.5 | 12.5 |
| | | | PLATING SOLUTION TEMPERATURE (° C.) | 80 | 80 | 80 | 80 | 80 | 80 | 80 |
| | | | STIRRING (rpm) | 200 | 200 | 200 | 200 | 200 | 200 | 200 |
| | | | PLATING TIME (min) | 120 | 120 | 120 | 120 | 120 | 120 | 120 |
| EVALUATION | | | STABILITY | ○ | ○ | ○ | ○ | ○ | ○ | ○ |
| | | | PLATING ADHESION EFFICIENCY (%) | 98.41 | 98.32 | 97.86 | 98.01 | 98.73 | 98.17 | 96.43 |
| | | | PATTERNABILITY | ○ | ○ | ○ | ○ | ○ | ○ | ○ |
| | | | STABILITY (AFTER LONG-TERM STORAGE) | x | x | x | x | x | x | ○ |
| | | | PLATING ADHESION EFFICIENCY (%) (AFTER LONG-TERM STORAGE) | 99.21 | 99.13 | 99.07 | 99.11 | 99.18 | 98.98 | 95.76 |
| | | | PATTERNABILITY (AFTER LONG-TERM STORAGE) | x | x | x | x | x | x | ○ |

| | | | | EX-AMPLE j2 | EX-AMPLE j3 | EX-AMPLE j4 | EX-AMPLE j5 | EX-AMPLE j6 | EX-AMPLE k1 | EX-AMPLE l1 |
|---|---|---|---|---|---|---|---|---|---|---|
| COMPO-SITION OF PLATING SO-LUTION | A4 SO-LUTION | SOLUBLE PLATINUM SALT | TETRA-AMMINEPLATINUM (II) CITRATE (g/L) [AS Pt] | 0.2 | 0.2 | 0.2 | 0.2 | 0.2 | 0.2 | 0.2 |
| | | pH BUFFER | AMMONIUM CITRATE (g/L) | 2 | 2 | 2 | 2 | 2 | 2 | 2 |
| | | SPECIFIC | GLUCOSE (g/L) | 0.05 | 0.05 | 0.05 | 0.05 | 0.05 | — | — |
| | | HYDROXY-METHYL COM-POUND | MANNOSE (g/L) | — | — | — | — | — | — | — |
| | | | FRUCTOSE (g/L) | — | — | — | — | — | — | — |
| | | | LACTOSE MONOHYDRATE (g/L) | — | — | — | — | — | — | — |
| | | | CELLOBIOSE (g/L) | — | — | — | — | — | — | — |
| | | | ACARBOSE (g/L) | — | — | — | — | — | — | — |
| | B4 SO-LUTION | REDUCING AGENT | HYDRAZINE MONOHYDRATE (mL/L) | 0.28 | 0.28 | 0.28 | 0.28 | 0.28 | 0.28 | 0.28 |
| | | COM-PLEXING AGENT | 25% AMMONIUM SOLUTION (mL/L) | 1 | 1 | 1 | 1 | 1 | 1 | 2 |
| | | | ETHYLENEDIAMINE (mL/L) | — | — | — | — | — | — | 0.08 |
| | | STA-BILIZER | 2-HYDROXYPYRIDINE (g/L) | — | — | — | — | — | — | — |
| | | | 2-METHYLPYRAZINE (g/L) | 0.42 | — | — | — | — | — | — |
| | | | 3-AMINOPYRIDAZINE (g/L) | — | 0.43 | — | — | — | — | — |
| | | | URACIL (g/L) | — | — | 0.5 | — | — | — | — |
| | | | BUTYNEDIOL (g/L) | — | — | — | 0.39 | — | — | — |
| | | | FUMARIC ACID (g/L) | — | — | — | — | 0.52 | — | — |
| PLATING CONDITION | | | pH (25° C.) | 12.5 | 12.5 | 12.5 | 12.5 | 12.5 | 12.5 | 12.5 |
| | | | PLATING SOLUTION TEMPERATURE (° C.) | 80 | 80 | 80 | 80 | 80 | 80 | 80 |
| | | | STIRRING (rpm) | 200 | 200 | 200 | 200 | 200 | 200 | 200 |
| | | | PLATING TIME (min) | 120 | 120 | 120 | 120 | 120 | 120 | 120 |

TABLE 13-continued

| | | | | | | | | |
|---|---|---|---|---|---|---|---|---|
| EVALUATION | STABILITY | ○ | ○ | ○ | ○ | ○ | x | ○ |
| | PLATING ADHESION EFFICIENCY (%) | 96.41 | 96.34 | 96.24 | 96.48 | 96.29 | 95.61 | 97.30 |
| | PATTERNABILITY | ○ | ○ | ○ | ○ | ○ | x | x |
| | STABILITY (AFTER LONG-TERM STORAGE) | ○ | ○ | ○ | ○ | ○ | x | x |
| | PLATING ADHESION EFFICIENCY (%) (AFTER LONG-TERM STORAGE) | 95.92 | 95.96 | 96.01 | 95.43 | 95.97 | 93.27 | 98.51 |
| | PATTERNABILITY (AFTER LONG-TERM STORAGE) | ○ | ○ | ○ | ○ | ○ | x | x |

Examples i1 to i6 relate to electroless platinum plating solutions using a hydrazine compound as a reducing agent and containing a specific hydroxymethyl compound belonging to sugar. For each solution, the plating time was 2 hours (120 minutes), the plating adhesion efficiency was 97% or more, and when the prepared plating solution was immediately subjected to plating processing, no out-of-pattern deposition or decomposition of the plating solution was confirmed.

On the other hand, in the same evaluation after long-term storage of the plating solution, out-of-pattern deposition and decomposition of the plating solution were confirmed.

Examples j1 to j6 relate to electroless platinum plating solutions using a hydrazine compound as a reducing agent, and containing an N-containing heterocyclic compound or an aliphatic unsaturated compound as a stabilizer and further containing glucose as a specific hydroxymethyl compound. For each solution, the plating time was 2 hours (120 minutes), the plating adhesion efficiency was 96% or more, and when the prepared plating solution was immediately subjected to plating processing, no out-of-pattern deposition or decomposition of the plating solution was confirmed.

In addition, also in the same evaluation after long-term storage of the plating solution, no out-of-pattern deposition or decomposition of the plating solution was confirmed.

Example k1 relates to an electroless platinum plating solution using a hydrazine compound as a reducing agent and containing no stabilizer and no specific hydroxymethyl compound. For each solution, the plating time was 2 hours (120 minutes) and when the prepared plating solution was immediately subjected to plating processing, out-of-pattern deposition and decomposition of the plating solution were confirmed.

In addition, also in the same evaluation after long-term storage of the plating solution, out-of-pattern deposition and decomposition of the plating solution were confirmed.

Example l1 relates to an electroless platinum plating solution using a hydrazine compound as a reducing agent, using ammonia and ethylenediamine in combination as a complexing agent, and containing no specific hydroxymethyl compound. For each solution, the plating time was 2 hours (120 minutes), the plating adhesion efficiency was 97% or more, and when the prepared plating solution was immediately subjected to plating processing, no decomposition of the plating solution was confirmed, but out-of-pattern deposition was confirmed.

In addition, also in the same evaluation after long-term storage of the plating solution, decomposition of the plating solution was confirmed.

As described above, according to the electroless platinum plating solution of the present invention, it can be seen that even when a hydrazine compound is used as a reducing agent, adding a specific hydroxymethyl compound exhibits excellent patternability, and adding a stabilizer exhibits excellent long-term storage.

INDUSTRIAL APPLICABILITY

When the electroless platinum plating solution of the present invention is used, a plating film having high deposition efficiency and high patternability can be formed. In addition, the electroless platinum plating film obtained from the electroless platinum plating solution of the present invention does not contain impurities such as sulfur or heavy metals. The electroless platinum plating solution of the present invention is widely used for formation of platinum plating films for electronic parts, ornaments and heat-resistant materials, etc.

REFERENCE SIGNS LIST

1 Electroless platinum plating solution
2 Glass beaker
3 Substrate for evaluation
3*a* Catalyst layer
4 Stirrer

The invention claimed is:

1. An electroless platinum plating solution containing a soluble platinum salt, a complexing agent, and a reducing agent that is any of a borohydride compound, an aminoborane compound, and a hydrazine compound, the electroless platinum plating solution having a pH of 7 or more, and containing a specific hydroxymethyl compound represented by a following formula (1) or a salt thereof:

$$R^1—CH_2—OH \quad (1)$$

wherein $R^1$ is an atomic group having an aldehyde group or a ketone group, and wherein the specific hydroxymethyl compound represented by the formula (1) is at least one selected from the group consisting of a sugar, a cyclic carboxylic acid or a salt thereof, and hydroxymethylfurfural.

2. The electroless platinum plating solution according to claim 1, wherein the sugar is at least one selected from the group consisting of glyceraldehyde, dihydroxyacetone, erythrose, threose, ribulose, xylulose, ribose, deoxyribose, arabinose, xylose, lyxose, psicose, fructose, sorbose, tagatose, glucose, galactose, mannose, allose, altrose, dihydroxyacetone dimer, lactose, lactulose, maltose, cellobiose, and maltotriose.

3. The electroless platinum plating solution according to claim 1, wherein the cyclic carboxylic acid is at least one compound selected from the group consisting of ascorbic acid, erythorbic acid, dehydroascorbic acid, dehydroerythorbic acid and diketogulonic acid, and salts thereof.

4. The electroless platinum plating solution according to claim 1, wherein the soluble platinum salt is at least one compound selected from the group consisting of tetraammineplatinum (II) salt, hexaammineplatinum (IV) salt, tetrachloroplatinate (II), hexachloroplatinate (IV), tetranitroplatinate (II), hexanitroplatinate (IV) and dinitrodiammineplatinum (II).

5. The electroless platinum plating solution according to claim 1, wherein the complexing agent is a linear polyamine compound or ammonia.

6. The electroless platinum plating solution according to claim 1, further containing an aliphatic unsaturated compound.

7. The electroless platinum plating solution according to claim 6, wherein the aliphatic unsaturated compound is an aliphatic unsaturated alcohol and/or an aliphatic unsaturated carboxylic acid.

8. The electroless platinum plating solution according to claim 1, further containing an N-containing heterocyclic compound.

9. The electroless platinum plating solution according to claim 8, wherein the N-containing heterocyclic compound is at least one compound selected from the group consisting of triazine, piperazine, piperidine, pyrazine, pyridine, pyrimidine, pyridazine and morpholine, and derivatives thereof.

10. The electroless platinum plating solution according to claim 1, wherein the sugar is reducible.

11. The electroless platinum plating solution according to claim 1, further comprising a stabilizer, wherein the stabilizer is at least one selected from the group consisting of a N-containing heterocyclic compound and aliphatic unsaturated compound.

12. The electroless platinum plating solution according to claim 1, wherein the electroless platinum plating solution is prepared by mixing a first solution containing the soluble platinum salt and the specific hydroxymethyl compound represented by the formula (1) or a salt thereof and a second solution containing the complexing agent, the reducing agent, and a stabilizer.

13. A solution A for initially making up the electroless platinum plating solution according to claim 1, the solution A containing a soluble platinum salt and a specific hydroxymethyl compound represented by a following formula (1) or a salt thereof:

$$R^1—CH_2—OH \quad (1)$$

wherein $R^1$ is an atomic group having an aldehyde group or a ketone group.

14. The solution A according to claim 13, wherein the specific hydroxymethyl compound represented by the formula (1) is a sugar.

15. The solution A according to claim 13, wherein the specific hydroxymethyl compound represented by the formula (1) is at least one compound selected from the group consisting of ascorbic acid, erythorbic acid, dehydroascorbic acid, dehydroerythorbic acid and diketogulonic acid, and salts thereof.

16. A solution B for initially making up the electroless platinum plating solution according to claim 1, the solution B containing a complexing agent and a reducing agent that is any of a borohydride compound, an aminoborane compound, and a hydrazine compound.

17. The solution B according to claim 16, further containing an aliphatic unsaturated compound and/or an N-containing heterocyclic compound.

18. An aqueous solution for preparing an electroless platinum plating solution according to claim 1 by adding a soluble platinum salt and a reducing agent that is any of a borohydride compound, an aminoborane compound, and a hydrazine compound, the aqueous solution containing a complexing agent and a specific hydroxymethyl compound represented by a following formula (1) or a salt thereof:

$$R^1—CH_2—OH \quad (1)$$

wherein $R^1$ is an atomic group having an aldehyde group or a ketone group.

19. The aqueous solution for preparing an electroless platinum plating solution according to claim 18, wherein the specific hydroxymethyl compound represented by the formula (1) is a sugar.

20. The aqueous solution for preparing an electroless platinum plating solution according to claim 18, wherein the specific hydroxymethyl compound represented by the formula (1) is at least one compound selected from the group consisting of ascorbic acid, erythorbic acid, dehydroascorbic acid, dehydroerythorbic acid and diketogulonic acid, and salts thereof.

* * * * *